US012286884B2

(12) United States Patent
Wang et al.

(10) Patent No.: US 12,286,884 B2
(45) Date of Patent: Apr. 29, 2025

(54) ROTARY DIGGING DRILL AND AMPHIBIOUS TUNNEL CONSTRUCTION ROBOT USING SAME

(71) Applicants: WUHAN CONSTRUCTION ENGINEERING GROUP CO., LTD., Wuhan (CN); INSTITUTE OF ROCK AND SOIL MECHANICS, CHINESE ACADEMY OF SCIENCES, Wuhan (CN)

(72) Inventors: Shuai Wang, Wuhan (CN); Aixun Wang, Wuhan (CN); Qingshan Meng, Wuhan (CN); Mingzhao Wang, Wuhan (CN); Wenxiang Li, Wuhan (CN); Tong Lu, Wuhan (CN); Ming You, Wuhan (CN); Xin Li, Wuhan (CN); Hui Wang, Wuhan (CN); Zhizhen Wu, Wuhan (CN); Keyang Wu, Wuhan (CN); Chen Liu, Wuhan (CN); Chen Qian, Wuhan (CN); Li Wang, Wuhan (CN); Wei Yang, Wuhan (CN); Yunjie Dong, Wuhan (CN); Shenghao Li, Wuhan (CN)

(73) Assignees: WUHAN CONSTRUCTION ENGINEERING GROUP CO., LTD., Wuhan (CN); INSTITUTE OF ROCK AND SOIL MECHANICS, CHINESE ACADEMY OF SCIENCES, Wuhan (CN)

( * ) Notice: Subject to any disclaimer, the term of this patent is extended or adjusted under 35 U.S.C. 154(b) by 0 days.

(21) Appl. No.: 18/838,499

(22) PCT Filed: Apr. 19, 2023

(86) PCT No.: PCT/CN2023/089193
§ 371 (c)(1),
(2) Date: Aug. 14, 2024

(87) PCT Pub. No.: WO2023/202614
PCT Pub. Date: Oct. 26, 2023

(65) Prior Publication Data
US 2025/0109689 A1 Apr. 3, 2025

(30) Foreign Application Priority Data
Apr. 21, 2022 (CN) ..... 202210423476.0

(51) Int. Cl.
*E21D 9/10* (2006.01)

(52) U.S. Cl.
CPC ..... *E21D 9/1006* (2013.01); *E21D 9/1093* (2013.01)

(58) Field of Classification Search
CPC ..... E21D 9/1006; E21D 9/1093–113
See application file for complete search history.

(56) References Cited

FOREIGN PATENT DOCUMENTS

CN 107165649 A 7/2017
CN 111335891 A * 6/2020
(Continued)

OTHER PUBLICATIONS

Zhang, Yu-bo, CN-111335891-A (translation). (Year: 2020).*
(Continued)

*Primary Examiner* — Tara Mayo
(74) *Attorney, Agent, or Firm* — Hemisphere Law, PLLC; Zhigang Ma

(57) ABSTRACT

A rotary digging drill includes three disk drills arranged in ascending order of diameter, each with a cavity therein. The disk drill includes two circular ring seats arranged side by side, multiple toothed digging buckets disposed at peripheries of the two circular ring seats, and ring gear racks respectively disposed on inner sides of the two circular ring
(Continued)

seats. Adjacent ones of the disk drills have the toothed digging buckets facing opposite directions, and the disk drills all rotate in a direction facing a large opening, enabling adjacent two of the three disk drills to rotate in opposite directions. The rotary digging drill further includes three disk drill supports that match the three disk drills in quantity and are configured to support and drive the three disk drills.

9 Claims, 20 Drawing Sheets

(56) References Cited

FOREIGN PATENT DOCUMENTS

| | | | | |
|---|---|---|---|---|
| CN | 111411975 | A | * | 7/2020 |
| CN | 113187476 | A | * | 7/2021 |
| CN | 113338975 | A | * | 9/2021 |
| RU | 2571471 | C2 | * | 12/2015 |

OTHER PUBLICATIONS

Bian et al., CN-111411975-A (translation). (Year: 2020).*
Wang et al., CN-113187476-A (translation). (Year: 2021).*
Yi et al., CN-113338975-A (translation). (Year: 2021).*
Majer et al., RU-2571471-C2 (translation). (Year: 2015).*
ISA (CNIPA), Written Opinion for PCT/CN2023/089193, Aug. 16, 2023.

* cited by examiner

ROTARY DIGGING DRILL AND AMPHIBIOUS TUNNEL CONSTRUCTION ROBOT USING SAME

FIELD OF TECHNOLOGY

The present invention pertains to the field of tunnel construction and particularly relates to a rotary digging drill and an amphibious tunnel construction robot using the rotary digging drill, which is mainly used in tunnel construction of engineering projects.

BACKGROUND

With the rapid development of China's infrastructure capabilities, there are a large number of tunnel construction projects. Underwater projects such as construction of tunnels that go through lake bottoms, riverbeds, and seabeds typically face complex operation conditions, making construction difficult. Underwater tunnels are typically built at straits, bays, estuaries, or the like and transportation pipes are constructed in the seabed to connect land regions. The construction difficulty and methods of underwater tunnels vary depending on the water depth and the geological conditions. The shield tunneling method is a relatively common construction method for underwater tunnel. The shield tunneling method is a fully mechanized construction method used in the underground excavation process. It involves advancing a shield machine through the ground, with an outer shell of the shield and segments supporting the surrounding rock to prevent collapses in the tunnel. In addition, a cutting apparatus is used to excavate the front soil, and the soil is then transported out of the tunnel by an unearthing machine. A hydraulic jack at the rear provides the forward thrust, and pre-fabricated concrete segments are assembled to form the tunnel structure. Deep underwater tunnels are influenced by underwater pressure and harsh environmental factors, resulting in high construction costs, long construction periods, significant labor consumption, and many adverse factors. In contrast to underwater tunnels, the conditions on land are generally better, but the geological conditions in nature are variable. For example, some mountains consist of fragmented rock mixed with soil and gravel. There are also special geological conditions, such as in the coastal islands and coral reefs in the South China Sea of China. The geological condition is the coral reefs, and the island body is brittle coral reefs. This is a special type of rock-soil medium that can fracture under conventional stress, which is detrimental to the overall stability of the coral reefs. During use of the conventional shield tunneling method for tunnel construction in such geological conditions, the disturbance and damage to the substrate caused by construction activities need to be fully considered. The applicability of the conventional shield tunneling method in such special projects needs further optimization.

SUMMARY

In view of this, an objective of the present invention is to provide a rotary digging drill formed by three disk drills and a guide drill of which adjacent two rotate in opposite directions for cancelling out the torques generated by the disk drills on the soil, addressing the issue of soil collapse of an inner wall of a tunnel in a brittle soil (such as coral reefs) caused by a unidirectional force.

Another objective of the present invention is to provide an amphibious tunnel construction robot with high efficiency and low costs while overcoming the foregoing issue of easy rupture in the brittle soil (for example, the coral reefs), thus replacing human labor in underwater and land tunnel construction. Through remote control, a specially designed rotary digging drill is used to excavate tunnels, cancelling out the localized torque on the soil, and reducing the fragmentation of the soil of the inner wall of the tunnel. A roadheader chassis support can dock and join with the support vehicle chassis for carrying out operations such as tunnel excavation, soil transportation, and tunnel support. Multiple support vehicle main body portions operate together to transport and mount tunnel support panels, as well as to transport soil in the tunnel, thus improving tunnel construction efficiency, reducing human labor input, and overcoming the challenges posed by harsh underwater environments.

To achieve the foregoing objectives, the present invention uses the following technical solution:

A rotary digging drill is provided, including:

three disk drills arranged in ascending order of diameter, each with a cavity therein.

The disk drill includes two circular ring seats arranged side by side, multiple toothed digging buckets disposed at peripheries of the two circular ring seats, and ring gear racks respectively disposed on inner sides of the two circular ring seats, and a periphery of the toothed digging bucket is provided with steel teeth and the toothed digging bucket has openings in different sizes at two ends.

Adjacent ones of the disk drills have the toothed digging buckets facing opposite directions, and the disk drills all rotate in a direction facing a large opening, enabling adjacent two of the three disk drills to rotate in opposite directions. The rotary digging drill further includes: three disk drill supports that match the three disk drills in quantity and are configured to support and drive the three disk drills, each two of the three disk drill supports being connected to each other; and a guide drill having a head end disposed at a front end of the disk drill with a minimum diameter and having a tail end running through the three disk drills.

Optionally, the disk drill support includes a welded trestle bearing the disk drill, multiple bearing seats disposed on the welded trestle, and multiple gear shafts in interference fitting with the multiple bearing seats. The ring gear rack is meshed with a gear on the gear shaft, one of the gear shafts is co-axially connected to an output shaft of a hydraulic speed reducing motor via a coupling, and the hydraulic speed reducing motor transmits power to the gear shaft via the coupling, so as to drive the disk drill to rotate circumferentially.

Optionally, the guide drill includes a hobbing drill, a guide drill drive box, and a guide-drill fixed square steel that are disposed sequentially, and a guide drill power transmission mechanism is disposed in the guide drill drive box. The hobbing drill includes a hobbing drill base, three conical hob bearing shafts uniformly distributed on a head portion of the hobbing drill base, and three conical hobs respectively connected to inner rings of the three conical hob bearing shafts, and a tail portion of the hobbing drill base is co-axially connected to a hobbing drill drive shaft configured to drive the hobbing drill base to rotate synchronously.

With the use of the foregoing structure, adjacent two of the three disk drills and the guide drill rotate in opposite directions. On a vertical plane, adjacent two of them exert tangential forces on the soil in opposite directions. For the whole soil contacted by the rotary digging drill, the tangential external force received by the vertical plane is the vector sum of four forces. The forces being opposite leads to a partial offset of the magnitude of the forces, reducing the issue of rupture caused by a large unidirectional force in the brittle soil, and solving the issue of soil collapse of an inner wall of a tunnel in the brittle soil caused by a unidirectional force. In addition, during rotation of the rotary digging drill, the three conical hobs of the guide drill and the small-diameter disk drill first dig and feed a small-diameter hole in a mountain for stabilizing a boring direction of the rotary digging drill. As the diameter of the disk drill becomes large until the disk drill completely feeds into the tunnel, the diameter of the hole is gradually enlarged to meet construction requirements. This type of feeding method allows the rock soil to be scraped down layer by layer during tunnel excavation, not only protecting the structure of the hole arm, but also helping to stabilize the boring direction of the rotary digging drill and the stability of the machine body, while reducing the boring resistance to a certain extent, and speeding up the boring efficiency.

Correspondingly, the present invention further claims to protect an amphibious tunnel construction robot, including the foregoing rotary digging drill, a roadheader chassis portion, a support vehicle chassis portion connected to the roadheader chassis portion via a docking mechanism, and a support vehicle main body portion disposed on the support vehicle chassis portion.

The roadheader chassis portion includes a roadheader chassis mechanism configured to fix and bear the rotary digging drill, the roadheader chassis mechanism includes a roadheader chassis support and two propellers that are disposed on two sides of the roadheader chassis support and face different directions, and a soil conveyor belt is disposed on a side above the roadheader chassis support.

An end of the roadheader chassis mechanism provided with the soil conveyor belt extends into the cavities of the three disk drills, and the soil conveyor belt is powered by a hydraulic motor to transport soil excavated by the rotary digging drill to the rear.

Optionally, the support vehicle chassis portion includes a support vehicle chassis mechanism, the support vehicle chassis mechanism includes a support vehicle chassis support, multiple concave beams disposed below the support vehicle chassis support, and a support vehicle docking mechanism mounting seat disposed at an end of the support vehicle chassis support, and the support vehicle docking mechanism mounting seat is mounted with a support vehicle docking mechanism.

Further, the support vehicle docking mechanism includes a magnetic suction docking plate, a docking buffer apparatus connected to the magnetic suction docking plate, and a protruding block and a groove disposed at docking ends of the magnetic suction docking plate, and a roadheader docking mechanism included by the support vehicle docking mechanism has a same structure with the support vehicle docking mechanism. The docking buffer apparatus included by the support vehicle docking mechanism docks with a docking buffer apparatus included by the roadheader docking mechanism. The protruding block is magnetic, the magnetic suction docking plate of the support vehicle docking mechanism and a magnetic suction docking plate of the roadheader docking mechanism are in absorbing fitting with each other via the protruding block and the groove respectively disposed on the magnetic suction docking plate of the support vehicle docking mechanism and a protruding block and a groove disposed on the magnetic suction docking plate of the roadheader docking mechanism, achieving locking, thus allowing for connection between the roadheader chassis portion and the support vehicle chassis portion.

Optionally, a lifting float box and a support arm are disposed below each of the roadheader chassis mechanism and the support vehicle chassis mechanism, a high pressure drainage pump is connected into the lifting float box via a high pressure water pipe, and the high pressure drainage pump is configured to pump water in and out of the lifting float box. The support arm includes a main arm and auxiliary arms extending or retracting at two ends of the main arm via hydraulic cylinders, and hydraulic automated guided vehicle (AGV) universal wheels are respectively disposed on ends of the auxiliary arms opposite to each other.

Optionally, the lifting float box includes a high-pressure sealed water tank and two propellers disposed on two opposite sides of the high-pressure sealed water tank and facing different directions. The propeller includes a propeller mounting seat and a first hydraulic motor disposed in the propeller mounting seat, and an output shaft of the first hydraulic motor is connected to a first rotary shaft to drive the first rotary shaft to rotate synchronously. A second hydraulic motor is disposed on a side wall of the first rotary shaft and has an output shaft connected to a third hydraulic motor. The third hydraulic motor is hinged with an end of the first rotary shaft via a pin shaft. The second hydraulic motor is capable of driving the entire third hydraulic motor to move around an axis of the second hydraulic motor. A propulsion turbine is disposed at an end of an output shaft of the third hydraulic motor and driven by the third hydraulic motor to rotate, and the three hydraulic motors cooperate to change a propulsion direction of the propulsion turbine for operation, achieving multi-angle propulsion.

Optionally, the support vehicle main body portion includes a rail car formed by I-shaped steel rails and I-shaped steel rollers. The I-shaped steel rails incline on oblique surfaces at two ends of the multiple concave beams, and the I-shaped steel rollers cooperate with the I-shaped steel rails and move along an axial direction of the I-shaped steel rail. Three support vehicle frames are disposed at an upper end of the I-shaped steel rollers. The support vehicle frame includes a welded steel frame supporting and bearing a tunnel support plate, and support plate support cylinders are disposed around the support vehicle frame. A Y-type hinge seat is disposed at an end of a telescopic end of the support plate support cylinder and hinged with a support plate hinge seat via a movable pin shaft of an electromagnetic controller. The electromagnetic controller is disposed on a side wall of the Y-type hinge seat, and the movable pin shaft of the electromagnetic controller co-axially cooperates with a pin hole of the Y-type hinge seat. Three tunnel support plates are supported by the support plate support cylinders disposed on a top and two side surfaces of the three support vehicle frames, the three tunnel support plates are connected via support plate hinge seats, and an angle between the three tunnel support plates is configured to be adjusted via the support plate support cylinders.

Further, a cargo box is disposed in the support vehicle frame, the cargo box includes an opening cargo box and a cargo box conveyor belt disposed in the opening cargo box, and the cargo box conveyor belt is driven by the hydraulic motor to convey soil in the opening cargo box to an apparatus tail portion. The tunnel support plate includes a curved support plate steel frame, a support plate arch top disposed on the curved support plate steel frame, and the support plate hinge seats disposed on the support plate steel frame. The support plate hinge seats serve as hinge nodes between the tunnel support plates to splice the three tunnel support plates into a half circular tunnel structure.

Compared with the prior art, the present invention has at least the following beneficial effects:

1. A propeller can be used for underwater operation or crawler chassis is substituted for land operation, and the float box below the chassis of the apparatus is fixedly connected to a docking mounting disk of the crawler chassis via bolts. During underwater operation, before launching the apparatus into water, a hoisting machine is used to assist in docking the apparatus chassis with a water box, and a worker connects them using bolts. After assembly, the apparatus can be placed underwater for use. During land operation, before the apparatus is transported, the hoisting machine is used to assist in docking the apparatus chassis with a crawler chassis, and the worker connects them using bolts. After assembly, the apparatus can be placed on lands for use. Through remote control, multi-scenario tunnel boring operation can be carried out underwater or on land. Applying robotic remote control improves the operation efficiency, reduces human labor input, and avoids losses such as casualties caused by complex and harsh environments.
2. Modular design separates tunnel boring from tunnel support plate mounting, enhancing the mobility and flexibility of the apparatus. A docking mechanism is used to dock a roadheader chassis portion with the support vehicle chassis portion for carrying out operations such as tunnel excavation, soil transportation, and tunnel support. Multiple support vehicle main body portions operate together to transport and mount tunnel support plates while also transporting soil in the tunnel, thereby improving the efficiency of tunnel construction. Compared with a shield tunneling machine, the apparatus has the following differences: 1. In terms of use environment, the apparatus is suitable for both underwater and land application scenarios and more compact and structurally agile than the shield tunneling machine, allowing for deep excavation in complex, narrow, and trench-like underwater environments. 2. Structurally, the apparatus features an independent design for a boring module and a transport module, where the transport module can directly transport soil excavated in the tunnel, eliminating the need for a construction vehicle; and the transport module can be independently docked and controlled both underwater and on land, and transport tunnel support panels from storage locations on either a surface vessel or a land-based support platform. Multiple transport modules operate in coordination, flexibly handling various tasks such as soil transport, and support panel transport and mounting, thus allowing for high mobility, usage flexibility, and high operational efficiency. 3. The drill of the apparatus operates differently from that of the tunnel tunneling machine. The tunnel tunneling machine uses a rotating cutter head to break through the soil for excavation, and the apparatus includes three disk drills and a guide drill of which adjacent two rotate in opposite directions for cancelling out the torques generated by the disk drills on the soil, addressing the issue of soil collapse of an inner wall caused by a unidirectional force during tunnel construction in a brittle soil, and thus the apparatus is suitable for tunnel boring scenarios in brittle land soils and in island reefs along the Belt and Road.
3. The rotary digging drill is formed by three disk drills and a guide drill of which adjacent two rotate in opposite directions for cancelling out the torques generated by the disk drills on the earth, addressing the issue of soil collapse of an inner wall of a tunnel in a brittle soil caused by a unidirectional force. In addition, in a case that underwater cables and pipelines, when being laid, are obstructed by underwater mountains or trenches, the design dimensions of the apparatus can be adjusted according to needs. The specifications of the drills combined and the size of the apparatus body can be changed to adapt to the size and specifications of thick pipelines and cables, allowing for flexible excavation of tunnels through which cables and pipelines can pass, thereby meeting the requirements for cable and pipeline laying. It can be applied more widely in engineering fields that typically require underwater cables and pipeline laying.
4. The apparatus chassis portion includes a steel frame, a propeller, a high-pressure water pump, and the like. The propeller is used for underwater operation and a remote control method is used to transport, build up, and mount tunnel support plates underwater or on land, solving problems such as the harsh pipeline environment and extremely high water pressure in laying cables underwater, thus reducing human labor input and hazards. The entire apparatus is of a stable steel frame structure, reducing weight and costs.

BRIEF DESCRIPTION OF THE DRAWINGS

The drawings described herein are used to provide a better understanding of this application and form a part of this application. The exemplary embodiments and their descriptions in this application are intended for explaining this application and do not constitute a limitation on this application.

FIG. 6 is a structural diagram of a disk drill a.

In the figure:

Figure 1:
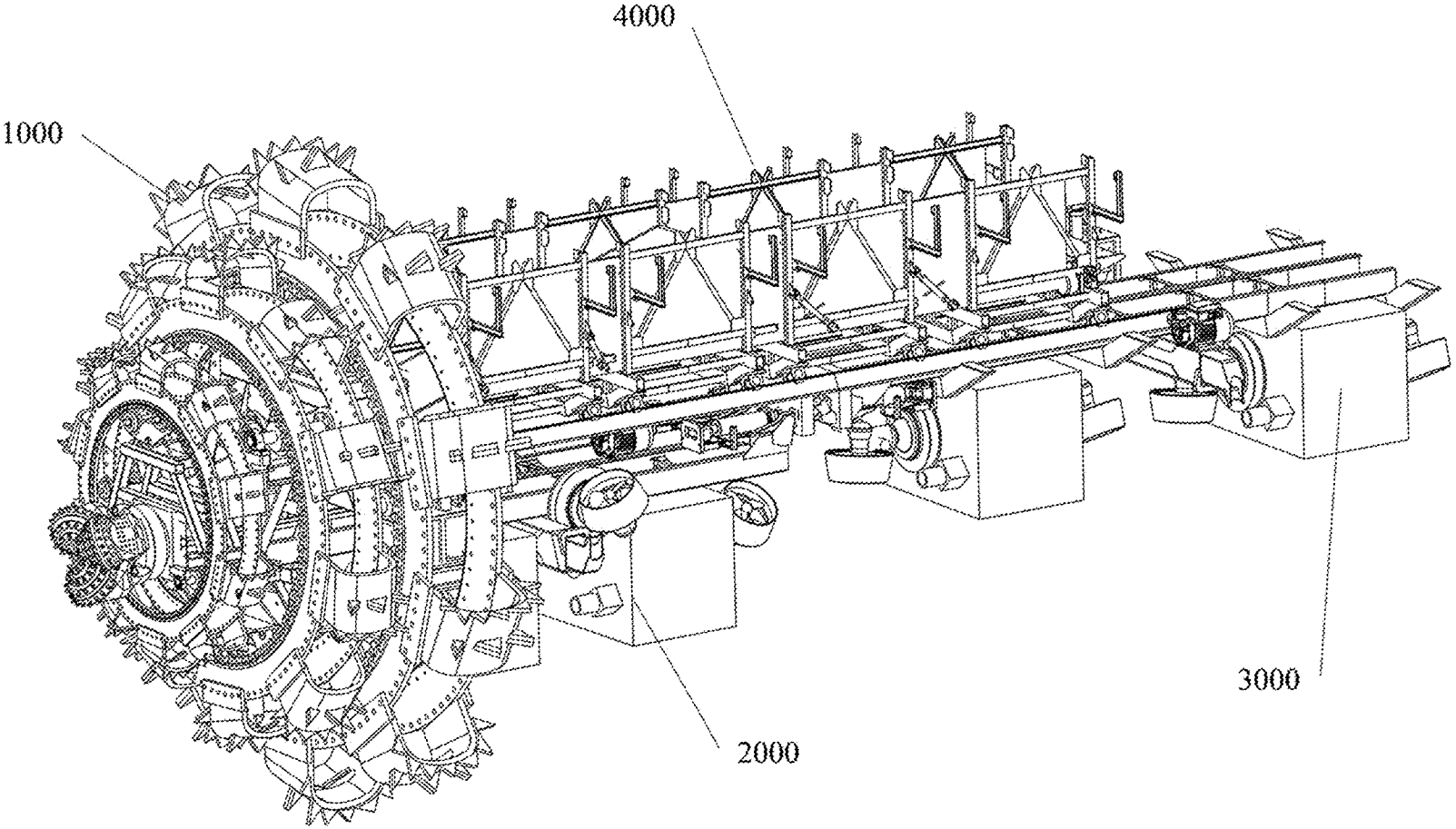
FIG. 1 is a diagram of an internal overall structure.
Figure 2:
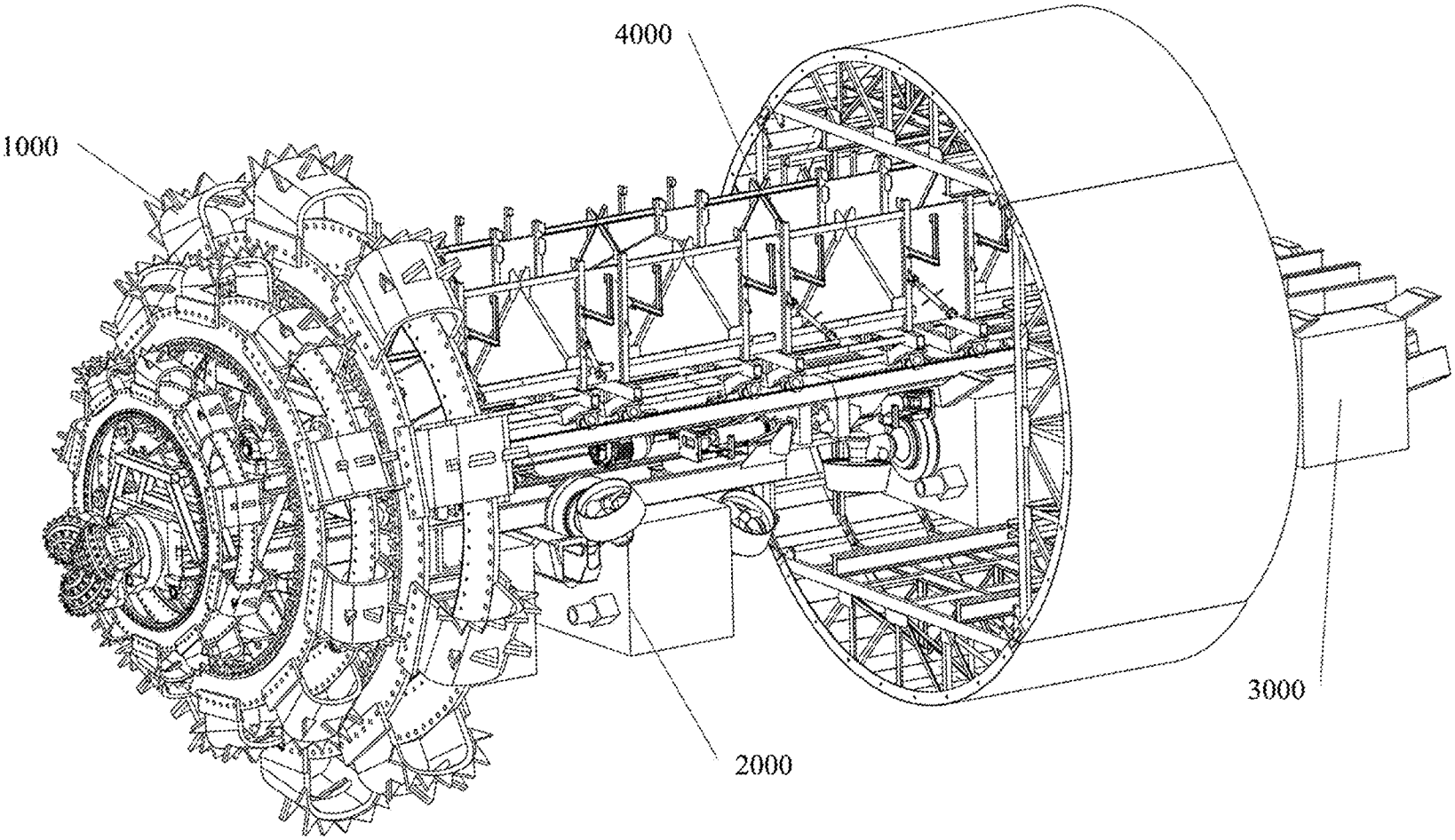
FIG. 2 is a diagram of an overall structure with a single-ring support plate.
Figure 3:
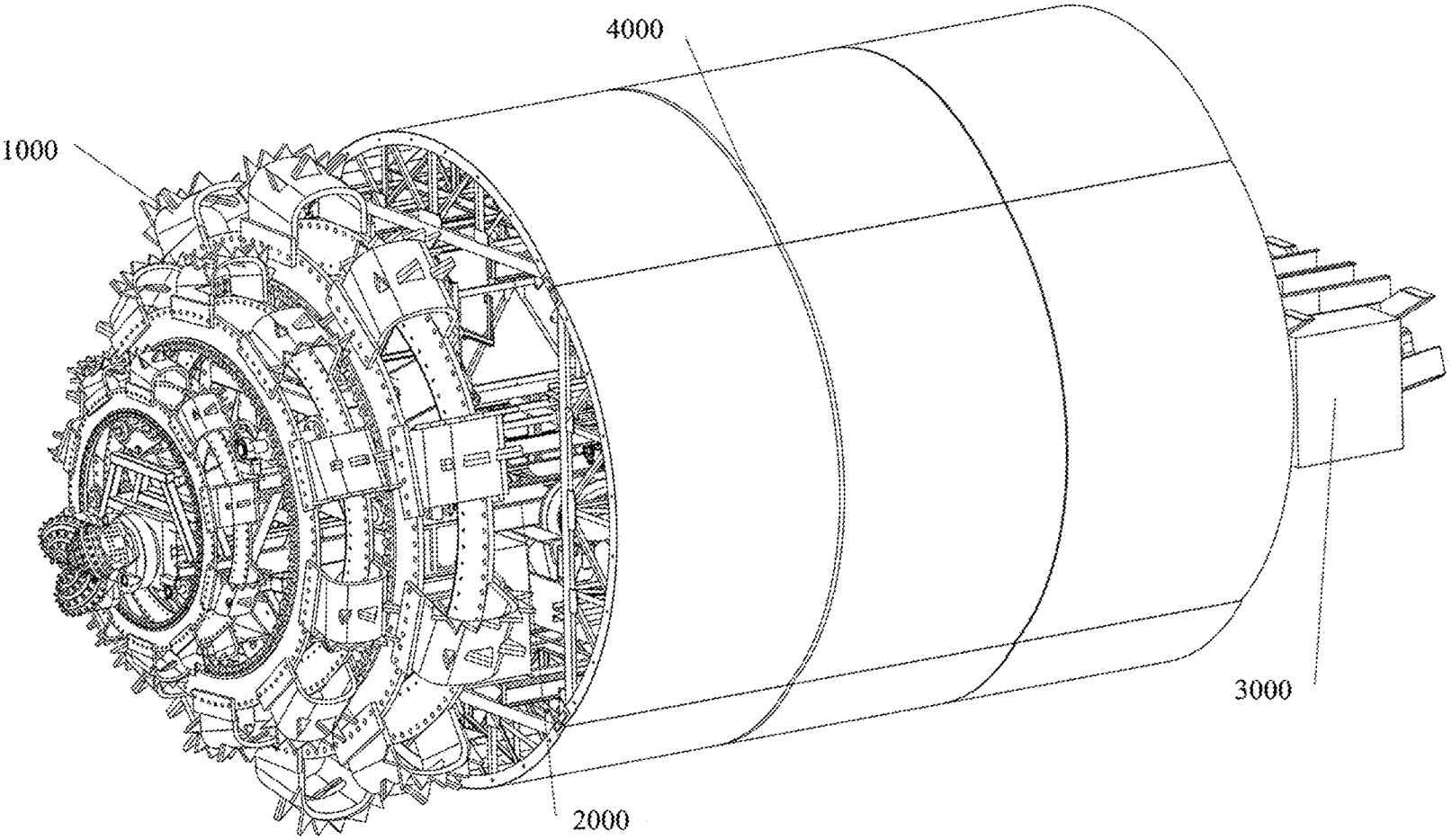
FIG. 3 is a diagram of an overall structure with a multi-ring support plate.
Figure 4:
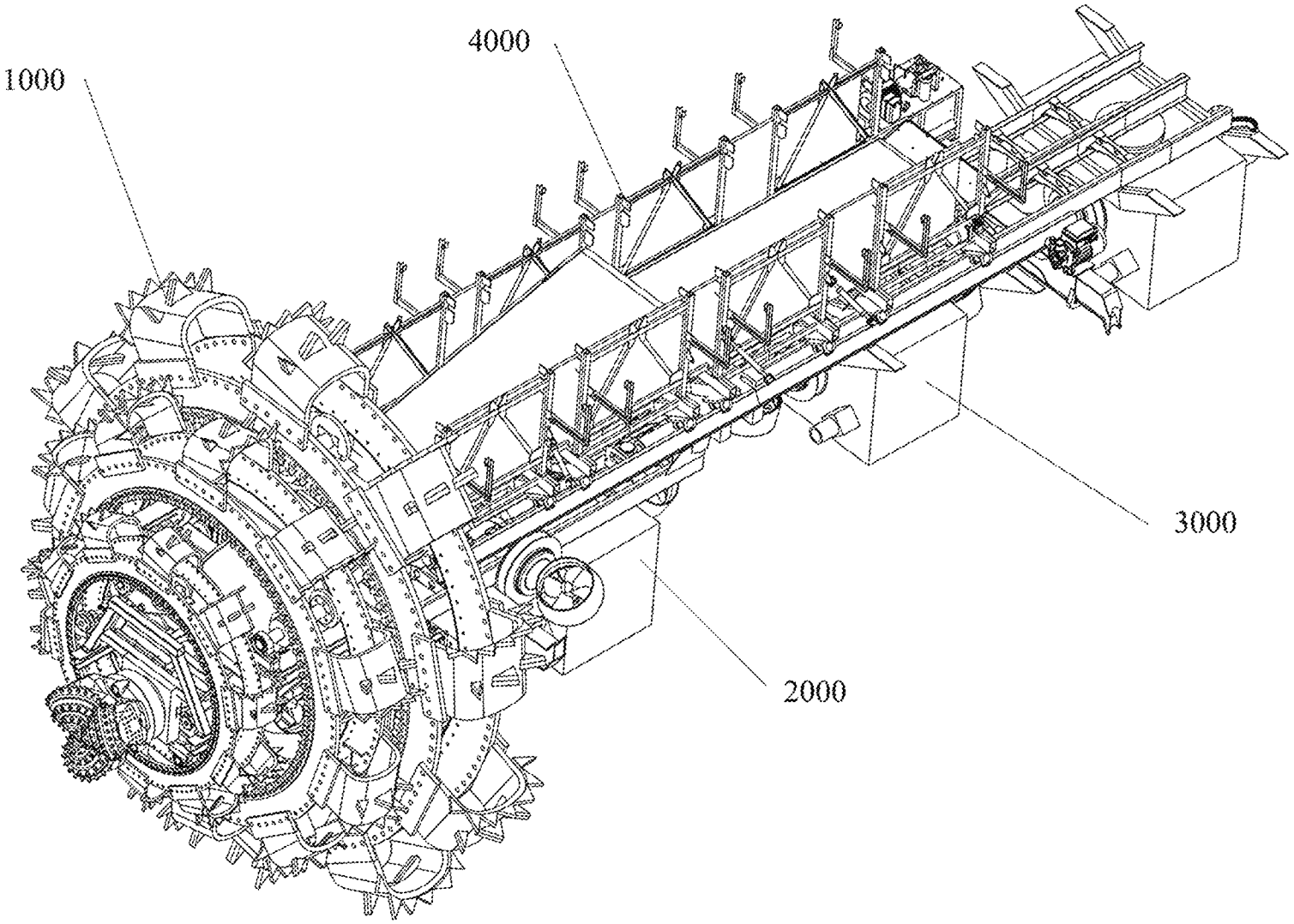
FIG. 4 is an axial structural view of an apparatus.

1000. rotary digging drill;

1100. disk drill a;

1101. circular ring seat a, 1102. circular ring seat b; 1103. toothed digging bucket a, 1104. ring gear rack a, 1105. ring gear rack b, 1106. hydraulic speed reducing motor a; 1107. steel tooth a;

1120. disk drill a support, 1121. welded trestle, 1122. gear shaft a, 1123. bearing seat, 1124. gear shaft mounting seat, 1125. gear shaft b, 1126. gear shaft c, 1127. gear shaft d; 1128. gear;

1200. disk drill b;

1201. circular ring seat c, 1202. circular ring seat d, 1203. toothed digging bucket b, 1204. ring gear rack c, 1205. ring gear rack d, 1206. hydraulic speed reducing motor b; 1207. steel tooth b;

1220. disk drill b support;

1300. disk drill c;

1301. toothed digging bucket c, 1302. circular ring seat e, 1303. circular ring seat f, 1304. ring gear rack e, 1305. hydraulic speed reducing motor c, 1306. drill fixing support seat, 1307. ring gear rack f; 1308. steel tooth c;

1320. disk drill c support;

1400. guide drill

1410. hobbing drill

1401. hobbing drill drive shaft, 1402. hobbing drill base, 1403. conical hob a, 1404. conical hob b, 1405. conical hob c, 1406. conical hob bearing shaft;

1421. guide drill drive box, 1422. guide-drill fixed square steel;

1430. guide drill power transmission mechanism;

1431. hydraulic speed reducing motor d, 1432. worm speed reducer, 1433. hobbing drill power drive shaft, 1434. drive shaft support bearing, 1435. small gear, 1436. large gear;

2000. roadheader chassis portion;

2100. roadheader chassis mechanism;

2101. roadheader chassis support, 2102. propeller a, 2103. propeller b, 2104. soil conveyor belt;

2200. lifting float box a;

2300. lifting float box b;

2400. support arm a;

2401. main arm, 2402. auxiliary arm a, 2403. auxiliary arm b, 2404. hydraulic AGV universal wheel a, 2405. hydraulic AGV universal wheel b;

2500. hydraulic power portion a;

2501. hydraulic motor, 2502. hydraulic pump, 2503. control valve, 2504. hydraulic oil storage tank;

2600. hydraulic power portion b;

2700. high pressure drainage pump;

2800. roadheader docking mechanism;

2810. docking buffer apparatus a;

2820. docking buffer apparatus b;

2831. magnetic suction docking plate a, 2832. protruding block; 2833. conical groove;

3000. support vehicle chassis portion;

3100. support vehicle chassis mechanism;

3101. support vehicle chassis support, 3102. concave beam, 3103. support vehicle docking mechanism mounting seat, 3104. reinforced beam, 3105. support arm b main arm, 3106. support arm b auxiliary arm,

3200. support vehicle docking mechanism;

3210. docking buffer apparatus c;

3220. docking buffer apparatus d;

3231. magnetic suction docking plate b, 3232. conical protruding block; 3233. groove;

3300. lifting float box c;

3301. propeller c, 3302. high-pressure sealed water tank, 3303. propeller d, 3304. electromagnetic water valve; 3305. quick-connect disk base;

3301*a*. propeller mounting seat, 3301*b*. first hydraulic motor, 3301*c*. first rotary shaft, 3301*d*. second hydraulic motor, 3301*e*. propulsion turbine, 3301*f*. third hydraulic motor;

3400. lifting float box d;

3500. hydraulic power portion c;

3600. high pressure drainage pump b;

4000. support vehicle main body portion;

4100. rail car;

4101. I-shaped steel rail, 4102. I-shaped steel roller

4200. support vehicle frame a;

4201. welded steel frame, 4202. support plate support cylinder, 4203. rail car beam, 4204. support plate support arm, 4205. electromagnetic controller, 4206. movable pin shaft; 4207. Y-shaped hinge seat;

4300. support vehicle frame b;

4400. support vehicle frame c;

4500. cargo box;

4510. opening cargo box, 4520. cargo box conveyor belt;

4600. tunnel support plate;

4601. tunnel support plate arch top, 4602. support plate I-shaped steel, 4603. support plate steel frame, 4604. support plate hinge seat; and

5000. crawler chassis.

DESCRIPTION OF THE EMBODIMENTS

To facilitate the understanding and implementation of the present invention by those skilled in the art, a more detailed description of the present invention is provided below with reference to the accompanying drawings and exemplary embodiments. It should be understood that the exemplary embodiments described herein are intended solely for the purpose of illustrating and explaining the present invention and are not intended to limit the scope of the present invention.

Figure 14:
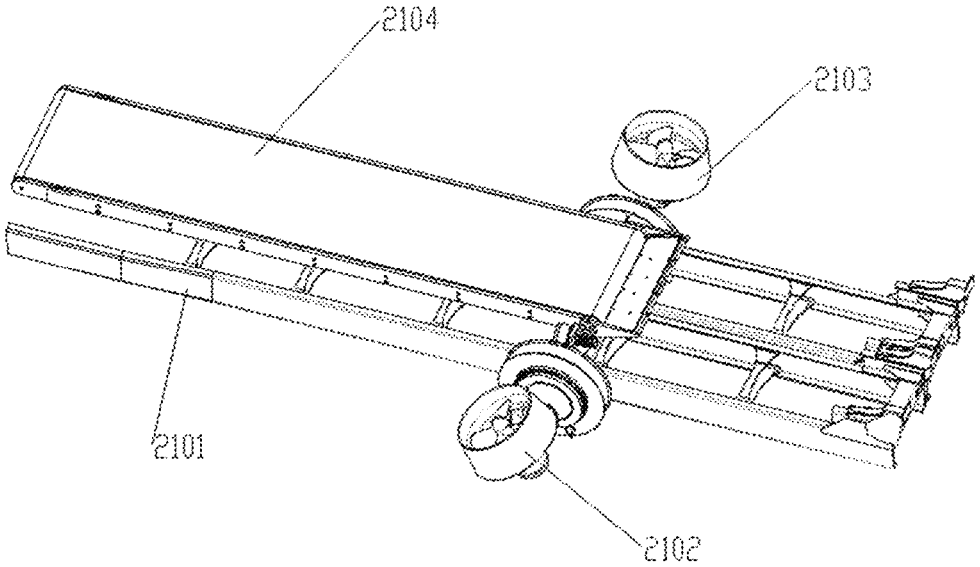
FIG. 14 is a structural diagram of a roadheader chassis support.

As shown in FIG. 14, an amphibious tunnel construction robot is provided, including a rotary digging drill 1000, a roadheader chassis portion 2000, a support vehicle chassis portion 3000, and a support vehicle main body portion 4000. The rotary digging drill 1000 and the roadheader chassis portion 2000 form a tunnel boring robot. The roadheader chassis portion 2000 includes a steel frame, propellers, conveyor belts, and the like, and is used to secure and bear the rotary digging drill 1000. The roadheader chassis portion 2000 can be used for underwater operation by using the propellers or used for land operation by substituting a crawler chassis 5000. Through remote control, tunnel boring operation is carried out underwater or on land. In addition, the roadheader chassis portion 2000 can be docked and joined with the support vehicle chassis portion 3000 through a docking mechanism to carry out tunnel excavation and support operation. The rotary digging drill 1000 includes three disk drills and a guide drill, and adjacent two of the three disk drills rotate in opposite directions for cancelling out the torques generated by the disk drills for the soil. The support vehicle chassis portion 3000 includes a steel frame, propellers, a high pressure water pump, and the like, and is used to secure and bear the support vehicle main body portion 4000. The support vehicle chassis portion 3000 can be used for underwater operation by using the propellers or used for land operation by substituting the crawler chassis 5000. A remote control method is used to transport, build up, and mount tunnel support plates underwater or on land. In addition, the support vehicle chassis portion 3000 can be docked and fixed with a tail portion of the roadheader chassis portion 2000 through the docking mechanism to carry out operations: tunnel excavation, soil transporting, and tunnel support plate mounting. The structures and positional connection relationships of the foregoing portions are described in detail below.

Figure 5:
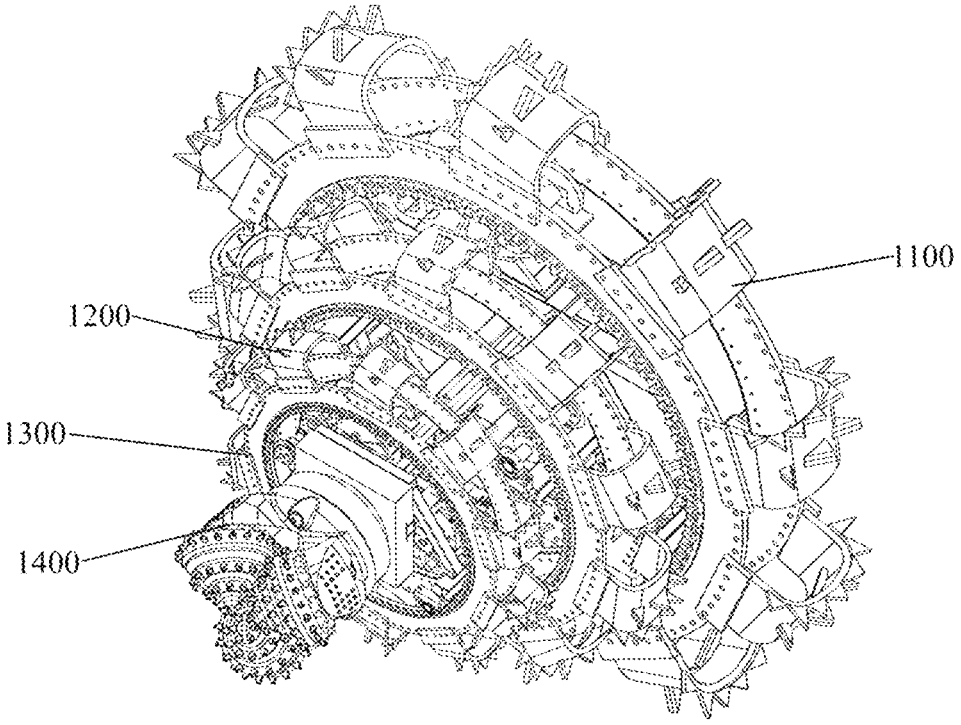
FIG. 5 is a diagram of an entire rotary digging drill.
Figure 29:
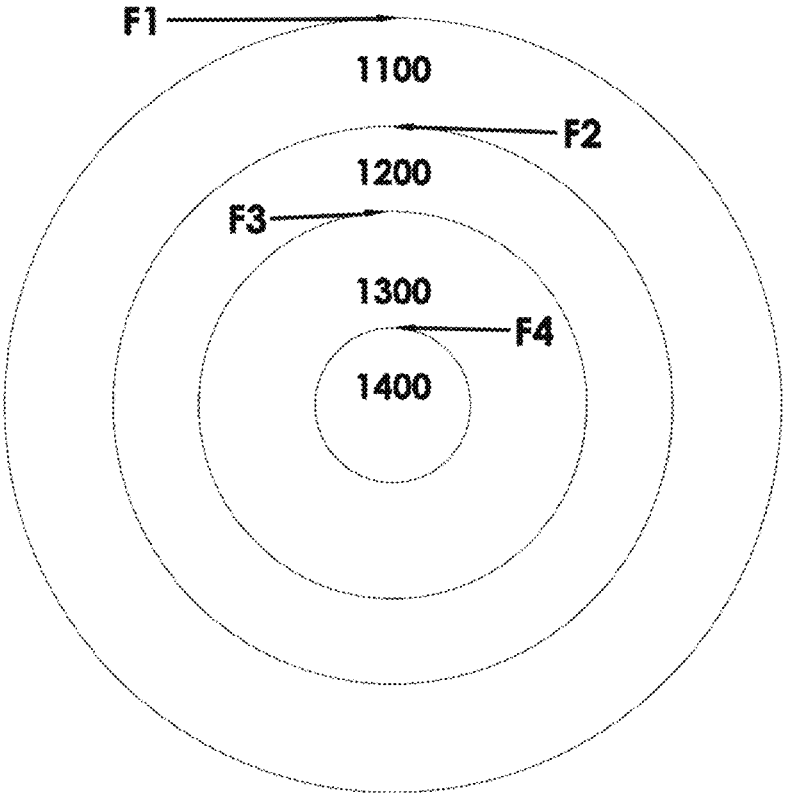
FIG. 29 is a diagram of drills expressing forces.

As shown in FIG. 5, the rotary digging drill 1000 is formed by a disk drill a 1100, a disk drill b 1200, a disk drill c 1300, and a guide drill 1400. The disk drill a 1100, the disk drill b 1200, and the disk drill c 1300 are arranged in an ascending order of diameter. The three disk drills and three conical hobs form a streamlined rotary digging drill 1000. When the rotary digging drill bores, the disk drills sequentially come into contact with the soil in an ascending order of diameter. During rotation of the rotary digging drill 1000, the three conical hobs of the guide drill 1400 and the small-diameter disk drill first dig and feed into a small-diameter hole in a mountain for stabilizing a tunnelling direction of the rotary digging drill 1000. As the diameter of the disk drill becomes large until the disk drill completely feeds into the tunnel, the diameter of the hole is gradually enlarged to meet construction requirements. This type of feeding method allows the rock soil to be scraped down layer by layer during tunnel excavation, not only protecting the structure of the hole arm, but also helping to stabilize the tunnelling direction of the rotary digging drill 1000 and the stability of the machine body, while reducing the tunnelling resistance to a certain extent, and speeding up the tunnelling efficiency. The foregoing three disk drills are each mounted with a toothed digging bucket, with one large opening at one end and a small opening at the other end. The large openings of the toothed digging buckets are provided facing the rotation direction of the disk drills. That is, the disk drills rotate towards the large openings of the toothed digging buckets. The toothed digging buckets of adjacent disk drills face opposite directions, resulting in opposite rotation directions for adjacent disk drills. In the boring direction of the guide drill, the disk drill a 1100 rotates clockwise, the disk drill b 1200 rotates counterclockwise, the disk drill c 1300 rotates clockwise, and the guide drill 1400 rotates counterclockwise. Adjacent two of the three disk drills rotate in opposite directions to cancel out the torque forces generated by the disk drills for the soil. For the specific forces, refer to FIG. 29. Adjacent two of the disk drill a 1100, the disk drill b 1200, the disk drill c 1300, and the guide drill 1400 rotate in opposite directions. In the vertical plane, their respective tangential forces on the soil are shown as F1, F2, F3, and F4 in FIG. 29. The directions of adjacent forces are opposite, resulting in the vector sum of the tangential external forces F1, F2, F3, and F4 on the soil contacted by the rotary digging drill 1000 in the vertical plane. Due to the opposite directions of the forces, the magnitudes of the forces partially cancel each other out, reducing the issue of brittle coral reef soil breaking due to a large unidirectional force and addressing the issue of soil collapse of an inner wall of a coral reef tunnel caused by a unidirectional force. The disk drill a support 1120 supports and drives the disk drill a 1100, the disk drill b support 1220 supports and drives the disk drill b 1200, and the disk drill c support 1320 supports and drives the disk drill c 1300. The three disk drill supports are fixedly connected via square steel and welded to the roadheader chassis support 2101. The guide drill 1400 is fixed to the roadheader chassis support 2101 through the guide-drill fixed square steel 1422 and driven to rotate by the guide drill power transmission mechanism 1430, crushing the soil rock wall and achieving the function of small hole excavation guidance. The structures and positional connection relationships of the foregoing portions are described in detail below.

Figure 6:
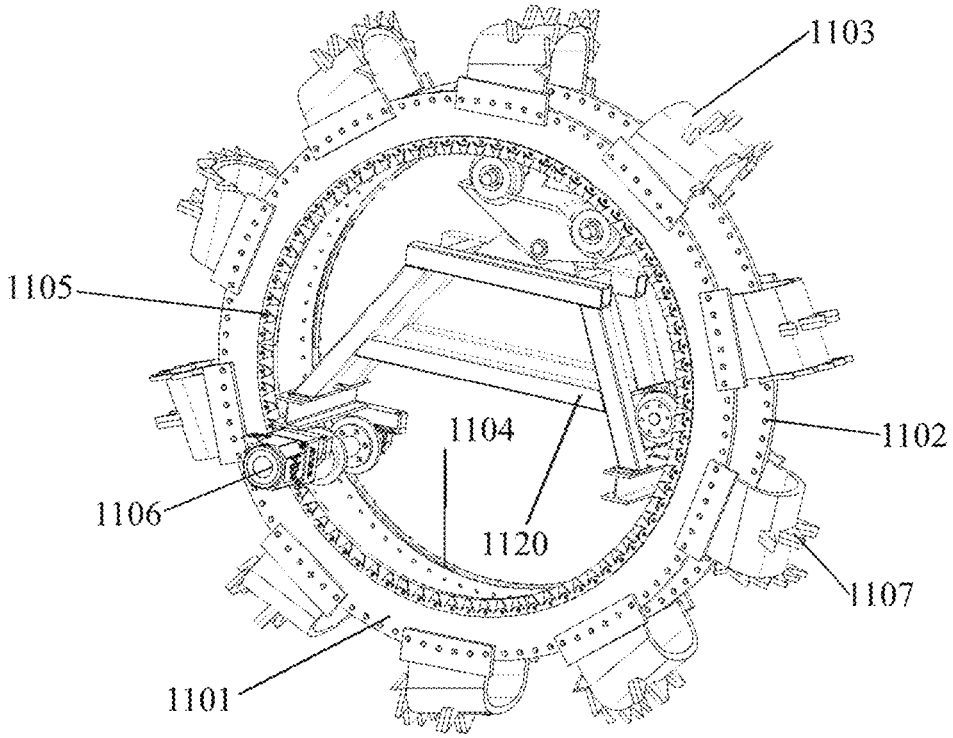

The disk drill a 1100 includes a circular ring seat a 1101, a circular ring seat b 1102, a toothed digging bucket a 1103, a ring gear rack a 1104, a ring gear rack b 1105, a hydraulic speed reducing motor a 1106, a disk drill a support 1120, a welded trestle 1121, a gear shaft a 1122, a bearing seat 1123, a gear shaft mounting seat 1124, a gear shaft b 1125, a gear shaft c 1126, and a gear shaft d 1127. The ring gear rack a 1104 and the ring gear rack b 1105 are respectively meshed with the two gears on the gear shaft a 1122, the gear shaft b 1125, the gear shaft c 1126, and the gear shaft d 1127 of the disk drill a support 1120. When each gear shaft rotates, it can drive the ring gear rack a 1104 and the ring gear rack b 1105 to rotate synchronously. The structure of the toothed digging bucket a 1103 is shown in FIG. 6. It is welded from irregular steel plates with three open sides, and the peripheral surface of the steel plate is welded with steel teeth a 1107 for scraping and crushing mountain soil. Its structure has openings at both ends, with one end having a large opening and the other end having a small opening. The disk drill a 1100 rotates towards the large opening of the toothed digging bucket a 1103. Multiple toothed digging buckets a 1103 are uniformly fixed and mounted on the circular ring seat a 1101 and the circular ring seat b 1102 via bolts. The ring gear rack a 1104 and the ring gear rack b 1105 are fixedly welded to the inner rings of the circular ring seat a 1101 and the circular ring seat b 1102. The hydraulic speed reducing motor a 1106 is a combination of a hydraulic motor and a speed reducer and driven by high-pressure hydraulic oil. Its output shaft is connected to the gear shaft a 1122 via a coupling, driving the gear shaft a 1122 to rotate synchronously. The gear shafts drive the ring gear rack a 1104 and the ring gear rack b 1105 to rotate synchronously, thus driving the circular ring seat a 1101, the circular ring seat b 1102, and the toothed digging bucket a 1103 to rotate. This is used to excavate and scrape the soil. When the toothed digging bucket a 1103 rotates above the soil conveyor belt 2104, the soil inside falls onto the soil conveyor belt 2104 and is transported into the cargo box 4500. The soil is then transported out of the tunnel through the support vehicle main body portion 4000. In case of a slurry condition, the conveyor belt cross-section is designed in a V-shaped recess form, with a rubber strip of certain height mounted transversely on its surface to block the flow of slurry and prevent slipping. During underwater operation, the falling trajectory and speed of sand and soil underwater differ from those on land. However, the excavation method of the present invention involves the circumferential cycle of the toothed digging bucket excavating sand and soil from bottom to top. Even if the sand and soil do not fall onto the conveyor belt, they will be excavated again. Additionally, the speed of the conveyor belt matches the boring speed of the drill. During underwater operation, the conveyor speed is reduced as much as possible when transportation conditions are met. Once the sand and soil fall onto the conveyor belt, they are less likely to move due to their own weight and are conveyed into the cargo box 4500. The soil is then transported out of the tunnel through the support vehicle main body portion 4000.

Figure 7:
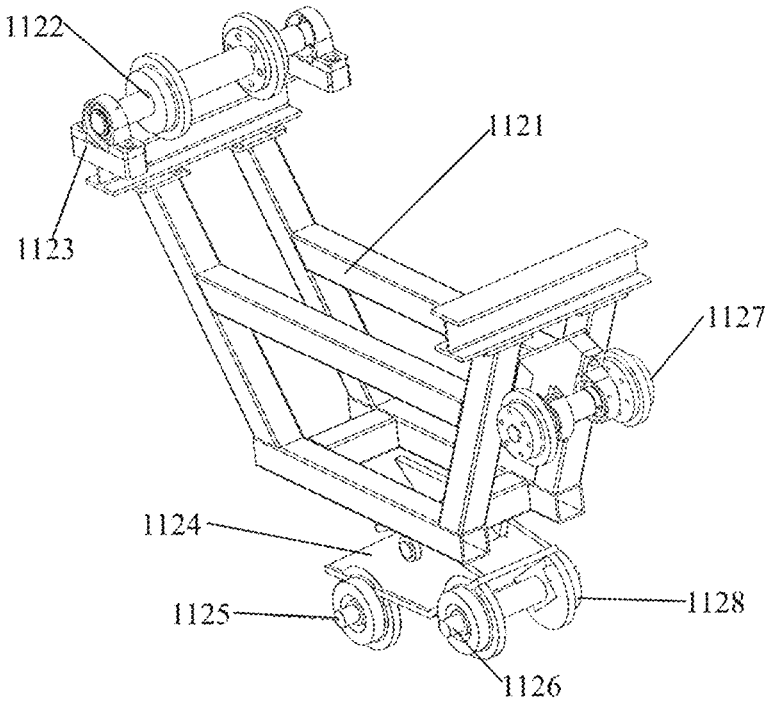
FIG. 7 is a structural diagram of an internal support of a disk drill.

The structure of the disk drill a support 1120 is shown in FIG. 7. Its welded trestle 1121 is a steel frame welded from high-strength square steel, serving as the main body for bearing and supporting the disk drill a 1100, and is fixed to the steel frame of the roadheader chassis portion 2000. The bearing seat 1123 is fixedly mounted above the welded trestle 1121. The gear shaft mounting seat 1124 is fixedly hinged with the welded trestle 1121 via a pin shaft. The gear shaft a 1122, the gear shaft b 1125, the gear shaft c 1126, and the gear shaft d 1127 consist of drive shafts and gears 1128 coaxially fixed to them. The drive shafts of the gear shafts are in interference fitting with inner holes of bearings of the bearing seat 1123 to support and stabilize the rotation of the gear shafts. The gear shaft a 1122 is coaxially connected to the output shaft of the hydraulic speed reducing motor a 1106 via a coupling. The hydraulic speed reducing motor a 1106 transmits power to the gear shaft a 1122 via the coupling, thereby driving the circumferential rotation of the disk drill a 1100.

Figure 8:
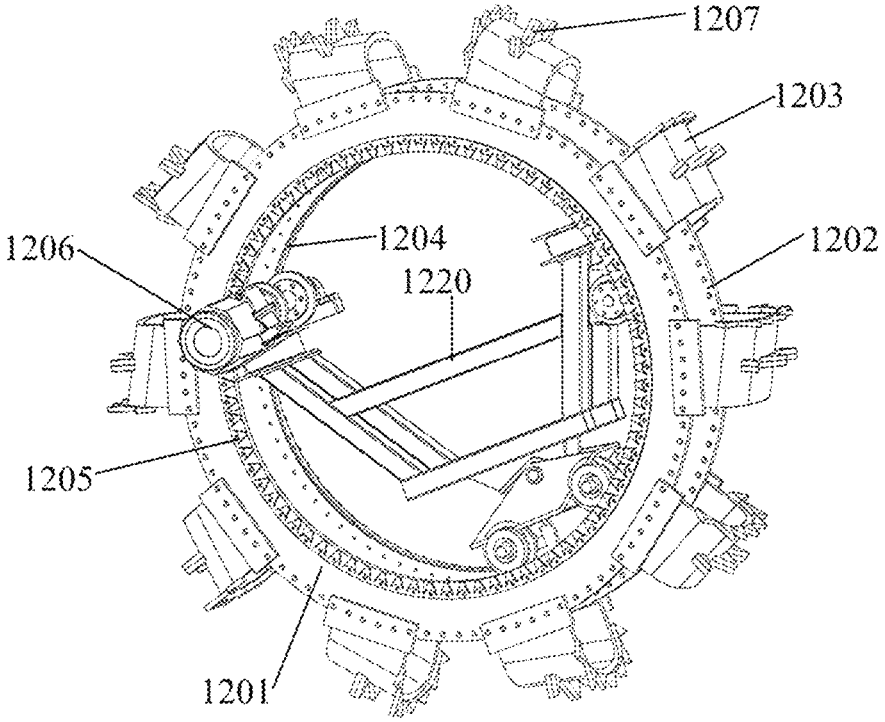
FIG. 8 is a structural diagram of a disk drill b.

The disk drill b 1200 includes a circular ring seat c 1201, a circular ring seat d 1202, a toothed digging bucket b 1203, a ring gear rack c 1204, a ring gear rack d 1205, a hydraulic speed reducing motor b 1206, and a disk drill b support 1220. The ring gear rack c 1204 and the ring gear rack d 1205 are respectively meshed with two gears on gear shafts of the disk drill b support 1220. When each gear shaft rotates, it can drive the ring gear rack c 1204 and the ring gear rack d 1205 to rotate synchronously. The structure of the toothed digging bucket b 1203 is shown in FIG. 8, which is welded from irregular steel plates with three open sides. The peripheral surface of the steel plate is welded with steel teeth b 1207 for scraping and crushing the soil of the mountain. Its structure has openings at both ends, one end having a large opening and the other having a small opening. The disk drill b 1200 rotates in the direction of the large opening of the toothed digging bucket b 1203, which is opposite to the rotation direction of the disk drill a 1100. Multiple toothed digging buckets b 1203 are uniformly fixed to the circular ring seat c 1201 and the circular ring seat d 1202 via bolts. The ring gear rack c 1204 and the ring gear rack d 1205 are fixedly welded to the inner rings of the circular ring seat c 1201 and the circular ring seat d 1202. The structure of the disk drill b support 1220 is the same as that of the disk drill a support 1120. The hydraulic speed reducing motor b 1206 is a combination of a hydraulic motor and a speed reducer, driven by high-pressure hydraulic oil. Its output shaft is connected to the gear shaft via a coupling, driving the gear shaft to rotate synchronously. The gear shafts drive the ring gear rack c 1204 and the ring gear rack d 1205 to rotate synchronously, thereby driving the circular ring seat c 1201, the circular ring seat d 1202, and the toothed digging bucket b 1203 to rotate, and is configured to dig and scrape the soil. When the toothed digging bucket b 1203 rotates above the soil conveyor belt 2104, the soil inside falls onto the soil conveyor belt 2104 and is transported into the cargo box 4500. The soil is then transported out of the tunnel through the support vehicle main body portion 4000.

Figure 9:
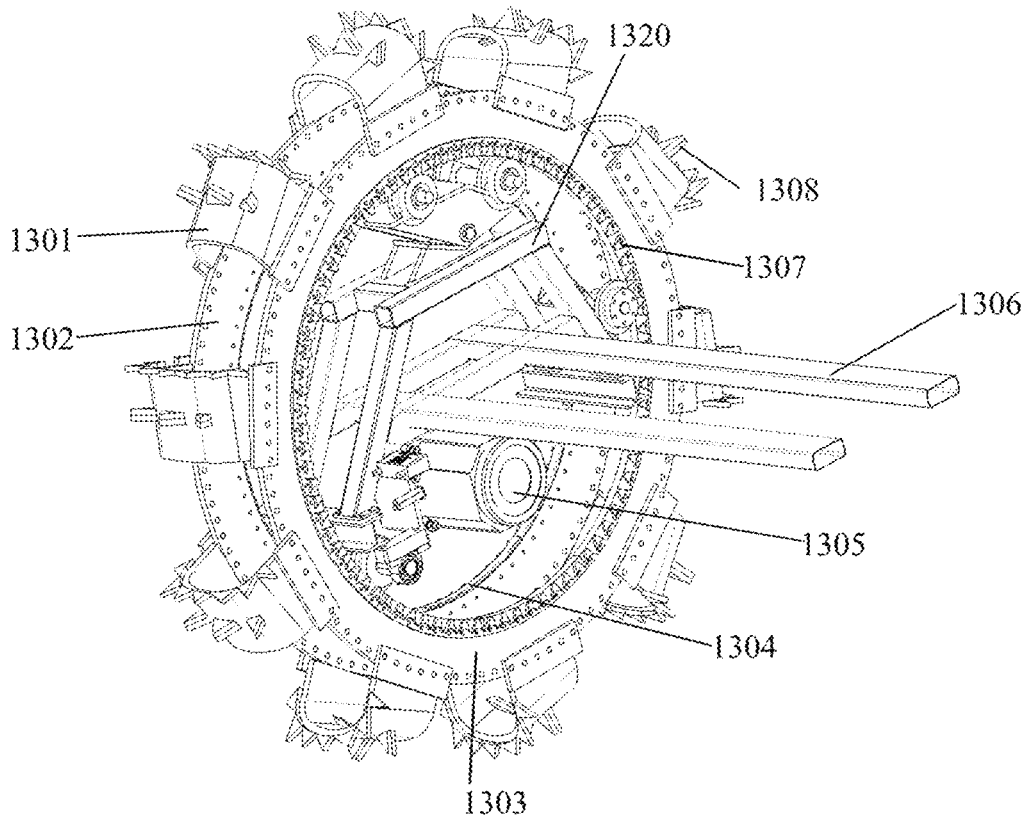
FIG. 9 is a structural diagram of a disk drill c.

The disk drill c 1300 includes a toothed digging bucket c 1301, a circular ring seat e 1302, a circular ring seat f 1303, a ring gear rack e 1304, a hydraulic speed reducing motor c 1305, a drill fixing support seat 1306, a ring gear rack f 1307, and a disk drill c support 1320. The drill fixing support seat 1306 is fixedly welded above the roadheader chassis support 2101, transmitting the force received by the rotary digging drill 1000 to the roadheader chassis support 2101. The ring gear rack e 1304 and the ring gear rack f 1307 are respectively meshed with two gears on gear shafts of the disk drill c support 1320. When each gear shaft rotates, it can drive the ring gear rack e 1304 and the ring gear rack f 1307 to rotate synchronously. The structure of toothed digging bucket c 1301 is shown in FIG. 9, which is welded from irregular steel plates with three open sides. The peripheral surface of the steel plate is welded with steel teeth c 1308 for scraping and crushing the soil of the mountain. Its structure has openings at both ends, one end having a large opening and the other having a small opening. The disk drill c 1300 rotates in the direction of the large opening of the toothed digging bucket c 1301, which is opposite to the rotation direction of disk drill b 1200. The multiple toothed digging buckets c 1301 are uniformly fixed to the circular ring seat e 1302 and the circular ring seat f 1303 via bolts. The ring gear rack e 1304 and the ring gear rack f 1307 are fixedly welded to the inner rings of the circular ring seat e 1302 and the circular ring seat f 1303. The structure of the disk drill c support 1320 is the same as that of disk drill a support 1120. The hydraulic speed reducing motor c 1305 is a combination of a hydraulic motor and a reducer, driven by high-pressure hydraulic oil. Its output shaft is connected to the gear shaft via a coupling, driving the gear shaft to rotate synchronously. The gear shafts drive the ring gear rack e 1304 and the ring gear rack f 1307 to rotate synchronously, thereby driving the circular ring seat e 1302, the circular ring seat f 1303, and the toothed digging bucket c 1301 to rotate, and is configured to dig and scrape the soil. When the toothed digging bucket c 1301 rotates above the soil conveyor belt 2104, the soil inside falls onto the soil conveyor belt 2104 and is transported into the cargo box 4500. The soil is then transported out of the tunnel through the support vehicle main body portion 4000.

Figure 10:
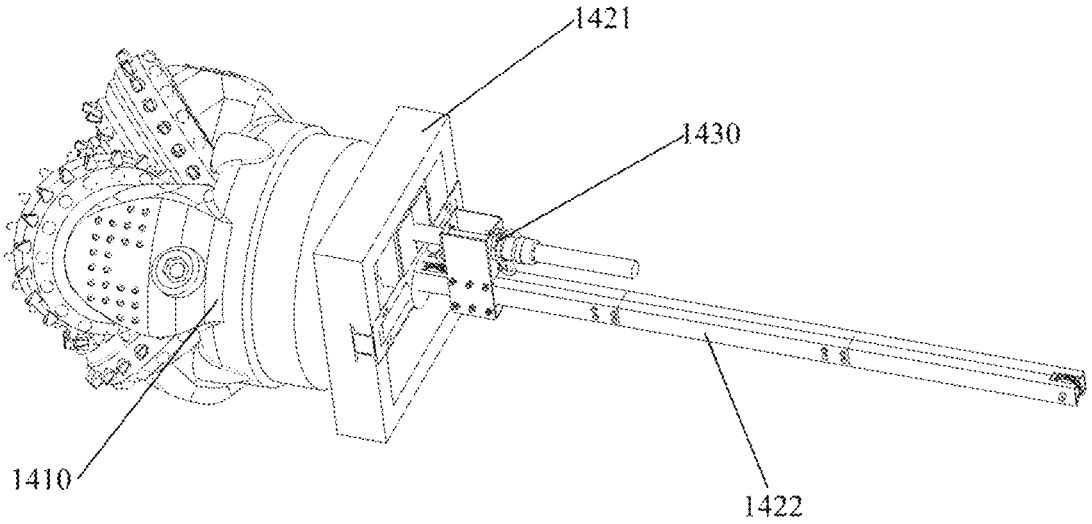
FIG. 10 is a structural diagram of an entire guide drill.
Figure 11:
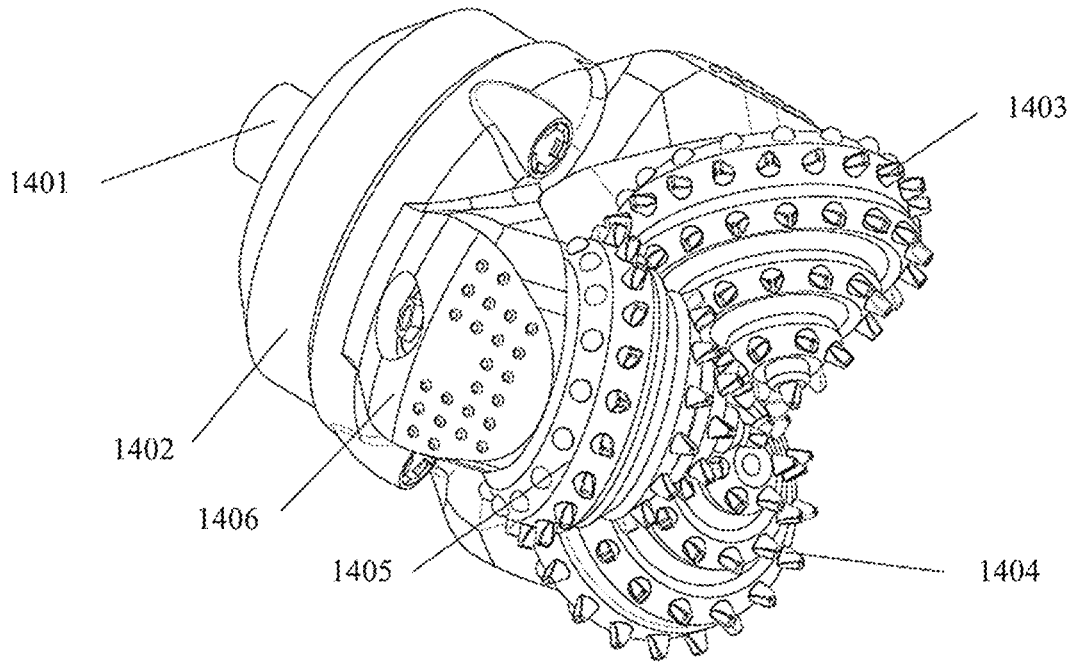
FIG. 11 is a structural diagram of a hobbing drill.

As shown in FIG. 10, the guide drill 1400 includes a hobbing drill 1410, a guide drill drive box 1421, a guide-drill fixed square steel 1422, and a guide drill power transmission mechanism 1430. The guide-drill fixed square steel 1422 is welded from square steel, fixed to the steel frame of the roadheader chassis portion 2000, and configured to support and stabilize the guide drill 1400. The guide drill drive box 1421 is a drive box for the guide drill 1400 and configured to protect the internal guide drill power transmission mechanism 1430 and to fixedly mount the hobbing drill 1410 via bearings. As shown in FIG. 11, the hobbing drill 1410 includes a hobbing drill drive shaft 1401, a hobbing drill base 1402, a conical hob a 1403, a conical hob b 1404, a conical hob c 1405, and a conical hob bearing shaft 1406. The hobbing drill base 1402 is a circular steel base, and the hobbing drill drive shaft 1401 is coaxially fixed to its tail, driving the hobbing drill base 1402 to rotate synchronously. The bottom seats of the three conical hob bearing shafts 1406 are uniformly distributed at the head of the hobbing drill base 1402. The conical hob a 1403, the conical hob b 1404, and the conical hob c 1405 are respectively connected to the inner rings of the three conical hob bearing shafts 1406. When the hobbing drill drive shaft 1401 drives the hobbing drill base 1402 to rotate, the conical hob a 1403, the conical hob b 1404, and the conical hob c 1405 contact the mountain wall to crush the soil of the mountain, and excavate a hole of the same size as the hobbing drill 1410 for guiding and constraining the excavation direction of the rotary digging drill 1000.

Figure 12:
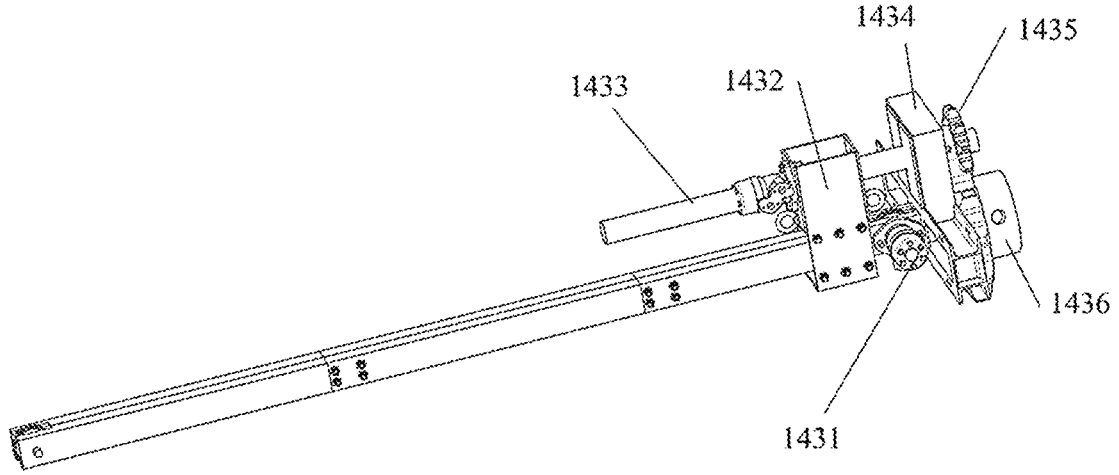
FIG. 12 is a structural diagram of a power portion of a guide drill.

As shown in FIG. 12, the guide drill power transmission mechanism 1430 includes a hydraulic speed reducing motor d 1431, a worm speed reducer 1432, a hobbing drill power drive shaft 1433, a drive shaft support bearing 1434, a small gear 1435, and a large gear 1436. The hydraulic speed reducing motor d 1431 is fixed to an end of the guide-drill fixed square steel 1422. Its output shaft fits with the input end of the worm speed reducer 1432 via a key slot and is driven by high-pressure hydraulic oil, driving the worm speed reducer 1432 to rotate synchronously. The output end of the worm speed reducer 1432 is connected to and fits with the hobbing drill power drive shaft 1433 via a key slot. The bottom seat of the drive shaft support bearing 1434 is fixed above the end of the guide-drill fixed square steel 1422. The inner ring of the bearing is in interference fitting with the hobbing drill power drive shaft 1433 and configured to stably support the normal rotation of the hobbing drill power drive shaft 1433. The small gear 1435 fits with an end of the hobbing drill power drive shaft 1433 via a key slot, and rotates synchronously with the hobbing drill power drive shaft 1433. The large gear 1436 fits with an end of the hobbing drill drive shaft 1401 via a key slot, rotates synchronously with the hobbing drill drive shaft 1401, and are meshed with the small gear 1435. The hydraulic speed reducing motor d 1431 transmits power to the worm speed reducer 1432, which, after reducing speed and increasing torque, drives the hobbing drill power drive shaft 1433 to rotate. With the use of the small gear 1435 and the large gear 1436, the speed is further reduced and the torque is increased, thus transmitting power to the hobbing drill drive shaft 1401. Consequently, when the hobbing drill base 1402 rotates, the conical hob a 1403, the conical hob b 1404, and the conical hob c 1405 contact the mountain wall and crush the soil of the mountain.

Figure 13:
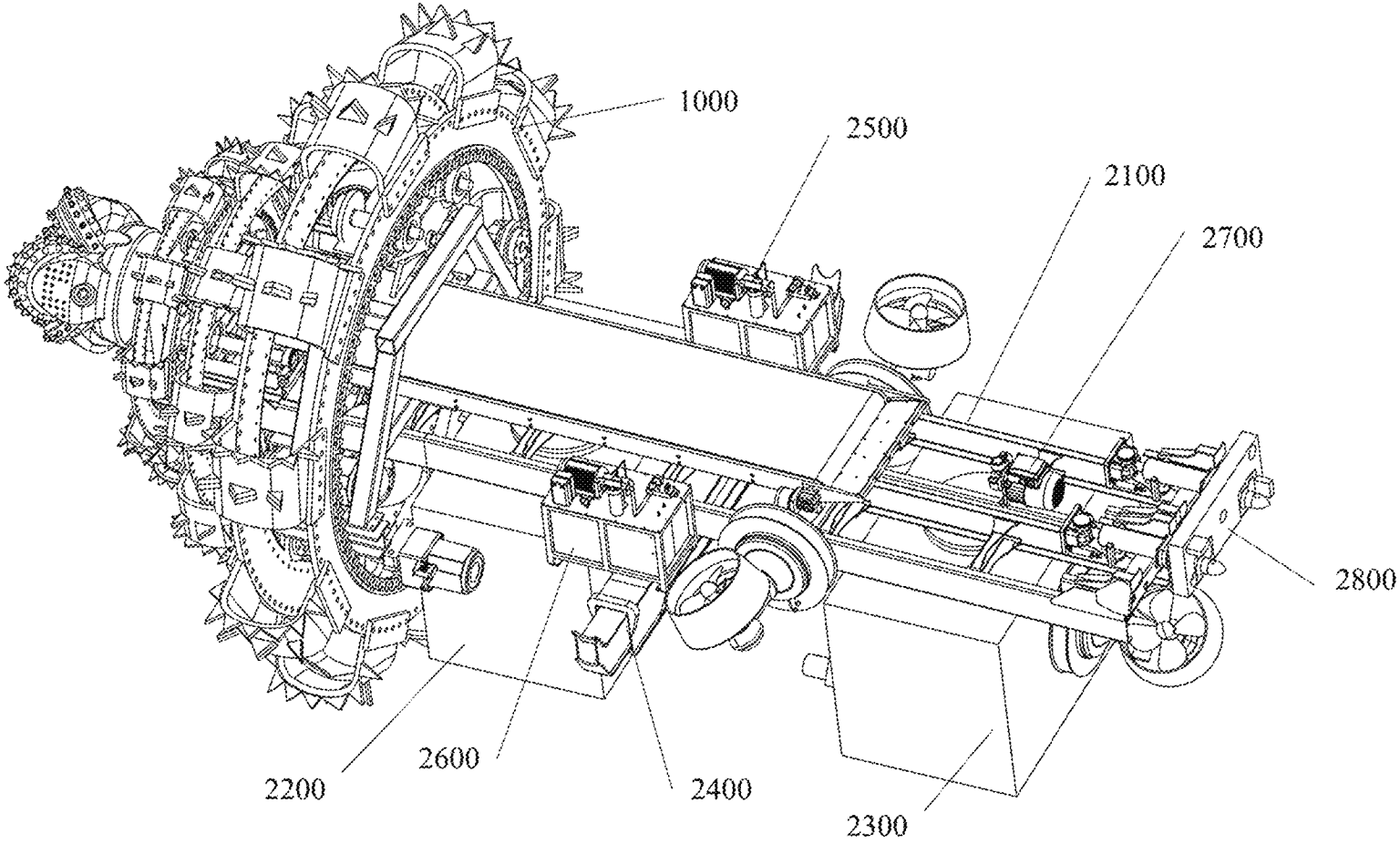
FIG. 13 is a structural diagram of a roadheader chassis portion.

As shown in FIG. 13, the roadheader chassis portion 2000 includes a roadheader chassis mechanism 2100, a lifting float box a 2200, a lifting float box b 2300, a support arm a 2400, a hydraulic power portion a 2500, a hydraulic power portion b 2600, a high pressure drainage pump a 2700, and a roadheader docking mechanism 2800. The roadheader chassis mechanism 2100 is configured to fix and bear the rotary digging drill 1000 and can enable the rotary digging drill 1000 to move and control the movement direction of the apparatus. The roadheader chassis mechanism 2100 includes a roadheader chassis support 2101, a propeller a 2102, a propeller b 2103, and a soil conveyor belt 2104. The structure of the roadheader chassis support 2101 is as shown in FIG. 14 and same as that of the support vehicle chassis support 3101. The roadheader chassis support 2101 is welded from a high-strength channel steel and a reinforced beam, possessing a high load-bearing capacity. The structures of the propeller a 2102 and the propeller b 2103 are the same as the structure of a propeller c 3301. They provide power to the apparatus through reverse thrust from turbines, while three hydraulic motors are used to complete switching of propulsion direction, achieving multi-angle propulsion. The propellers cooperate to complete the up, down, front, back, left, and right movement of the apparatus, improving the mobility and flexibility of the apparatus.

Figure 15:
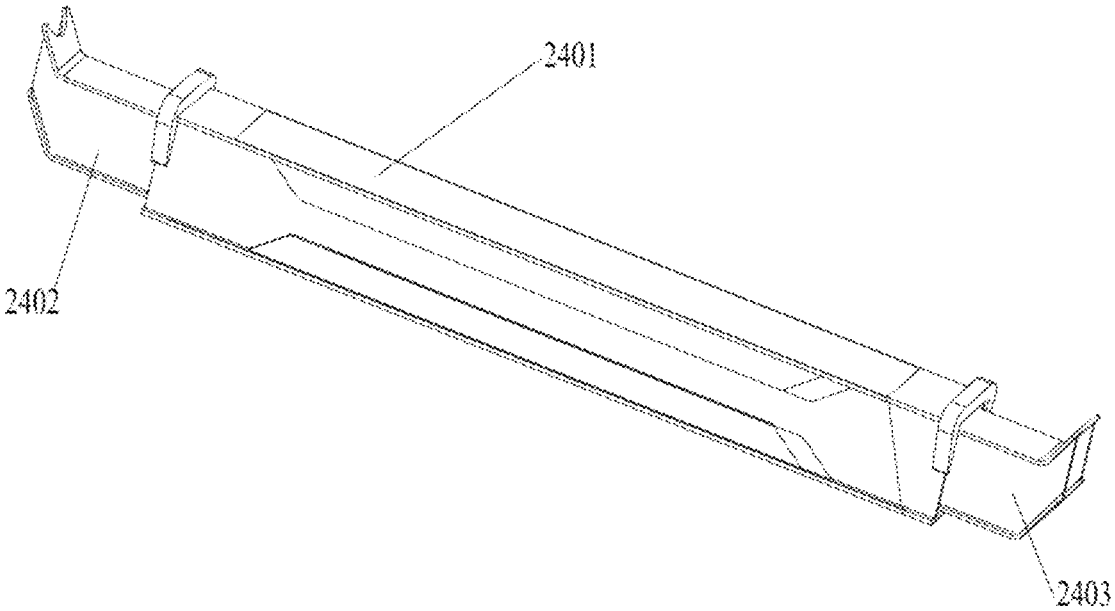
FIG. 15 is a structural diagram of a roadheader support arm.
Figure 16:
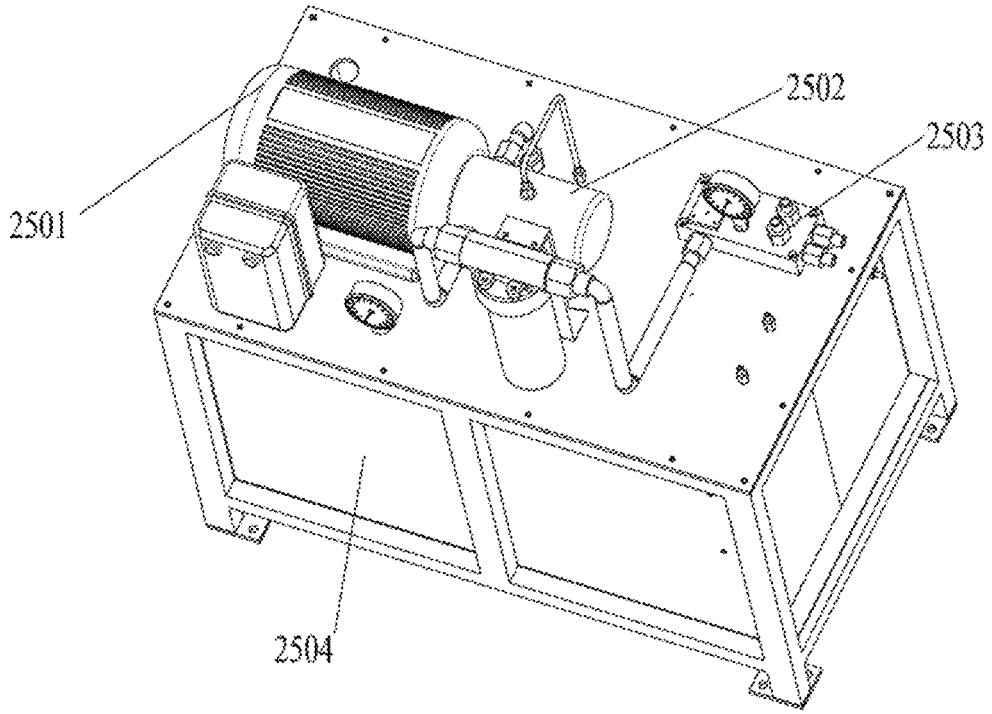
FIG. 16 is a structural diagram of a hydraulic power portion.
Figure 30:
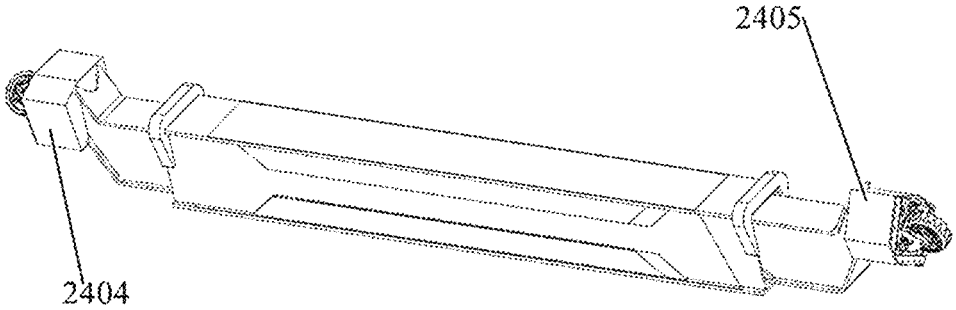
FIG. 30 is a structural diagram of a support arm.
Figure 31:
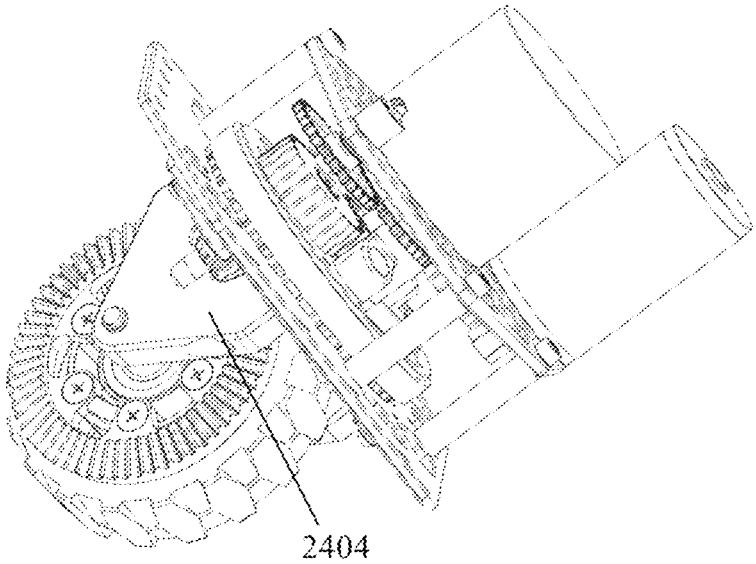
FIG. 31 is a structural diagram of a hydraulic AGV universal wheel.

As shown in FIGS. 14, 15, and 16, the soil conveyor belt 2104 is a conveyor belt driven by a hydraulic motor and powered by the hydraulic motor, transporting the soil excavated by the rotary digging drill 1000 to the rear of the apparatus, and transporting the soil out of the tunnel through the cargo box 4500 of the support vehicle main body portion 4000. The structures of the lifting float box a 2200 and the lifting float box b 2300 are the same as the structure of the lifting float box c 3300. They each consist of a high-strength water tank and two propellers. The high-strength water tank can withstand a high-pressure environment underwater. The high pressure drainage pump a 2700 is configured to pump water in and out of the lifting float box a 2200 and the lifting float box b 2300. When the apparatus needs to descend over a long distance, the electromagnetic water valve of the water tank can be opened, allowing seawater to fill the tank, increasing the weight of the apparatus and accelerating its descent. When the apparatus needs to ascend over a long distance, the high pressure drainage pump a 2700 is used to pump out part of the water from the tank, creating a certain negative pressure inside the tank, reducing the weight of the apparatus, and improving the propulsion efficiency of the propellers, thereby accelerating the ascent of the apparatus. The structure of the support arm a 2400 includes a main arm 2401, an auxiliary arm a 2402, an auxiliary arm b 2403, a hydraulic AGV universal wheel a 2404, and a hydraulic AGV universal wheel b 2405. Its structure is similar to a telescopic outrigger of a crane. Specifically, the main arm 2401 is made of high-strength hollow square steel and is fixedly welded below the roadheader chassis mechanism 2100. The auxiliary arm a 2402 and the auxiliary arm b 2403 can extend and retract within the main arm 2401 via hydraulic cylinders. The hydraulic AGV universal wheel a 2404 and the hydraulic AGV universal wheel b 2405 are mounted at opposite ends of the auxiliary arm a 2402 and the auxiliary arm b 2403, as shown in FIG. 30. During operation, the auxiliary arm a 2402 and auxiliary arm b 2403 extend out, allowing the gear-equipped wheels of the hydraulic AGV universal wheel a 2404 and the hydraulic AGV universal wheel b 2405 to contact the inner wall of the tunnel support plates or the inner wall of the tunnel. The structure and principle of the hydraulic AGV universal wheel a 2404 and the hydraulic AGV universal wheel b 2405 are the same as those of AGV mobile universal wheels available in the market, with the exception that this apparatus replaces electric motors with hydraulic motors for driving to meet underwater environment and stability requirements. Two hydraulic motors respectively control the powering and steering of the universal wheels. When the hydraulic AGV universal wheel a 2404 and the hydraulic AGV universal wheel b 2405 both contact the inner wall of the tunnel support plates or the inner wall of the tunnel, their wheels, equipped with steel teeth, ensure good adhesion. Based on the tilt status of the apparatus and control commands, the movement power and direction of the wheels are manually controlled. When the apparatus needs to remain stationary, the power hydraulic motor is controlled to stop outputting power, making the wheels stationary and well-adhered to the inner wall of the tunnel support plates or the inner wall of the tunnel. When the apparatus needs to bore the tunnel, the movement speed of the wheels can be controlled via the power hydraulic motor, and the movement direction of the wheels can be controlled via controlling the power hydraulic motor. On the premise of ensuring the apparatus is stable, this module can provide the apparatus with movement power, pushing the apparatus forward or backward and adjusting the boring direction of the apparatus. When the apparatus needs to move a long distance, the auxiliary arm a 2402 and the auxiliary arm b 2403 retract, causing the apparatus to lose support. Multiple propellers can be used for movement within the tunnel and adjusting the boring direction. The hydraulic power portion a 2500 includes a hydraulic motor (i.e., underwater motor) 2501, a hydraulic pump 2502, a control valve 2503, and a hydraulic oil storage tank 2504. The hydraulic motor 2501 is powered by a shipborne power source above water, driving the hydraulic pump 2502 to generate high-pressure hydraulic oil. The control valve 2503 distributes flow direction of the hydraulic oil and controls the on-off of the oil path. The hydraulic oil storage tank 2504 serves as a storage unit for hydraulic oil, providing hydraulic oil for the apparatus. The structure of the hydraulic power portion b 2600 is the same as that of the hydraulic power portion a 2500, and they jointly provide power for the rotary digging drill 1000 and the roadheader chassis portion 2000.

Figure 17:
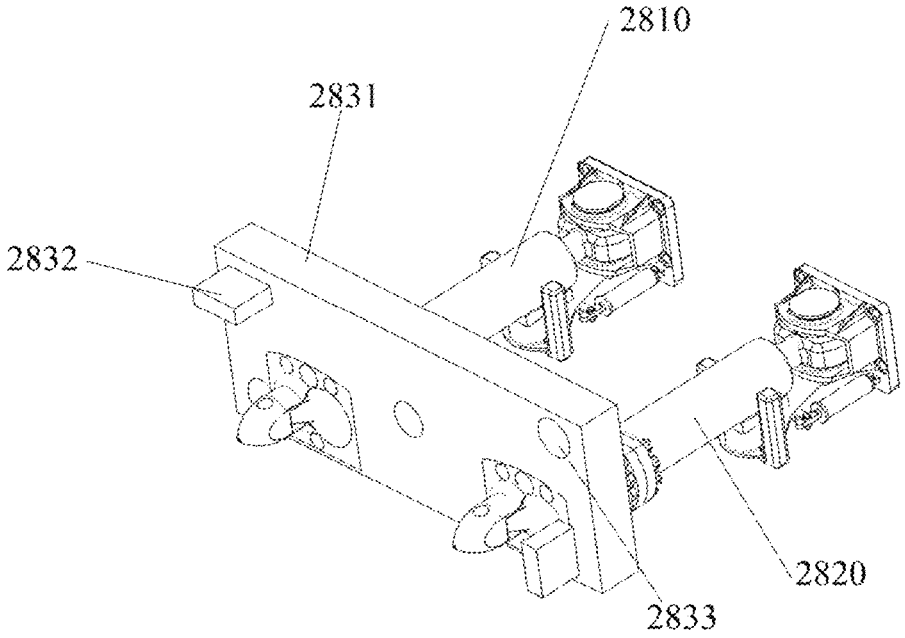
FIG. 17 is a structural diagram of a roadheader docking portion.

The output end of the high pressure drainage pump a 2700 is connected to the interiors of the lifting float box a 2200 and the lifting float box b 2300 via high pressure water pipes, and the input end of the high pressure drainage pump a 2700 is connected to the surrounding water. When the apparatus needs to descend over a long distance, the electromagnetic water valve of the water tank can be opened, allowing seawater to enter, increasing the weight of the apparatus, and accelerating its descent. When the apparatus needs to ascend over a long distance, the high pressure drainage pump a 2700 is used to extract part of the water from the tank, creating a certain negative pressure inside the tank, reducing the weight of the apparatus, improving the efficiency of the propellers, and accelerating the ascent of the apparatus. As shown in FIG. 17, the roadheader docking mechanism 2800 includes a docking buffer apparatus a 2810, a docking buffer apparatus b 2820, a magnetic suction docking plate a 2831, and a protruding block 2832. The magnetic suction docking plate a 2831 is bolted to the end of the roadheader chassis mechanism 2100. The structures of the docking buffer apparatus a 2810 and the docking buffer apparatus b 2820 are the same as the docking mechanism of a high-speed train carriage. When the docking buffer apparatus a 2810, the docking buffer apparatus b 2820, the docking buffer apparatus c 3210, and the docking buffer apparatus d 3220 are connected in pairs, their contact heads engage with each other, and the cylinders lock. The protruding block 2832 of the magnetic suction docking plate a 2831 is magnetic, and fits in an attracting manner into the groove 3233 on the magnetic suction docking plate b 3231. This guides the magnetic suction docking plate a 2831 and the magnetic suction docking plate b 3231 to be docked and locked, connecting the roadheader chassis portion 2000 and the support vehicle chassis portion 3000 into a whole, thus facilitating operation of soil transporting and support plate mounting.

Figure 18:
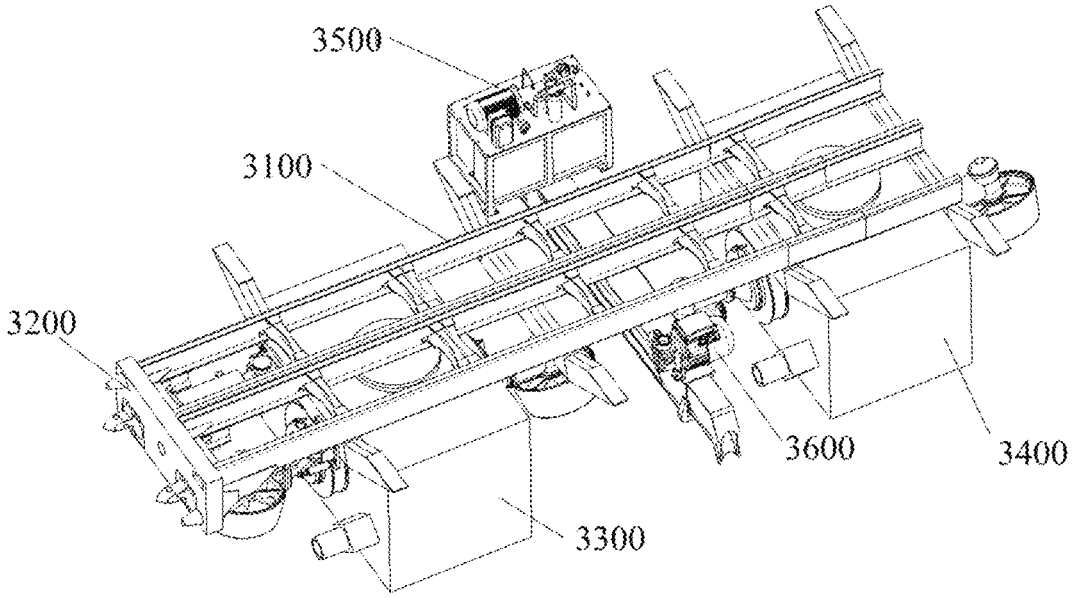
FIG. 18 is a structural diagram of a support vehicle chassis portion.
Figure 19:
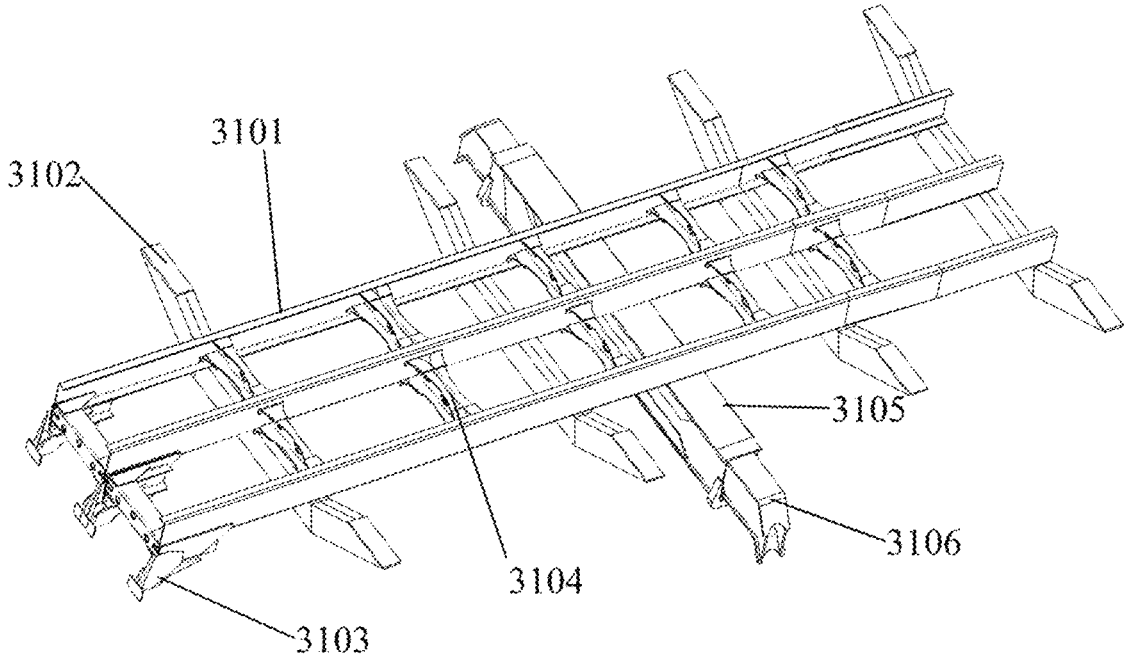
FIG. 19 is a structural diagram of a support vehicle chassis support.

As shown in FIG. 18, the support vehicle chassis portion 3000 includes a support vehicle chassis mechanism 3100, a support vehicle docking mechanism 3200, a lifting float box c 3300, a lifting float box d 3400, a hydraulic power portion c 3500, and a high pressure drainage pump b 3600. The support vehicle chassis mechanism 3100 is configured to support and bear the support vehicle main body portion 4000, and can propel and bear the support vehicle main body portion 4000, and control the movement direction of the apparatus. As shown in FIG. 19, the support vehicle chassis mechanism 3100 includes a support vehicle chassis support 3101, a concave beam 3102, a support vehicle docking mechanism mounting seat 3103, a reinforced beam 3104, a support arm b main arm 3105, a support arm b auxiliary arm 3106, and a hydraulic AGV universal wheel. The support vehicle chassis support 3101 is welded from a high-strength channel steel and a reinforced beam, possessing high load-bearing capacity. The structure of the concave beam 3102, as shown in FIG. 19, is fixedly welded below the support vehicle chassis support 3101. Multiple concave beams 3102 are uniformly distributed below the support vehicle chassis supports 3101, reinforcing the support vehicle chassis support 3101 and providing mounting support for the I-shaped steel rail 4101. Its inclined surface is bolted to the bottom surface of the I-shaped steel rail 4101. The support vehicle docking mechanism mounting seat 3103 is fixedly welded to the end of the support vehicle chassis support 3101, providing a mounting position for the support vehicle docking mechanism 3200. The reinforced beam 3104 is a short channel steel, welded between the channel steels of the support vehicle chassis support 3101, and configured to reinforce the support vehicle chassis support 3101. The structures of the support arm b main arm 3105 and the support arm b auxiliary arm 3106 are the same as that of the support arm a 2400. The support arm b main arm 3105 is made of high-strength hollow square steel, and fixedly welded below the support vehicle chassis support 3101. The two support arm b auxiliary arms 3106 can extend or retract within the support arm b main arm 3105 via hydraulic cylinders. The hydraulic AGV universal wheels are mounted at the opposite ends of the two support arm b auxiliary arms 3106. The principles of the hydraulic AGV universal wheel, the support arm b main arm 3105, and the support arm b auxiliary arm 3106 are the same as that of the support arm a 2400. During operation, the two support arm b auxiliary arms 3106 extend out, stabilizing the entire apparatus and ensuring the stability of tunnel excavation.

Figure 20:
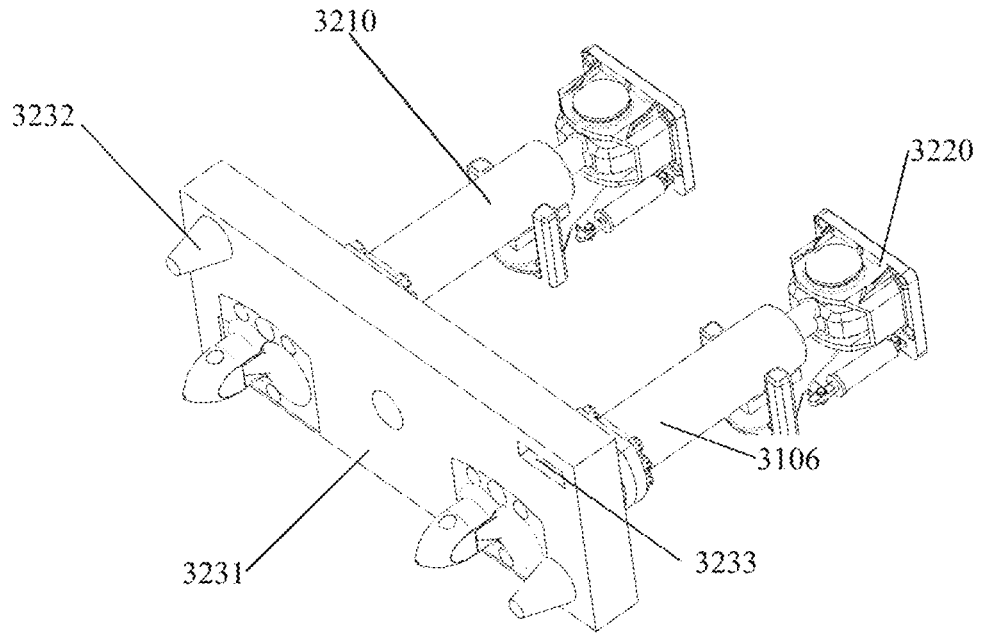
FIG. 20 is a structural diagram of a support vehicle docking portion.
Figure 32:
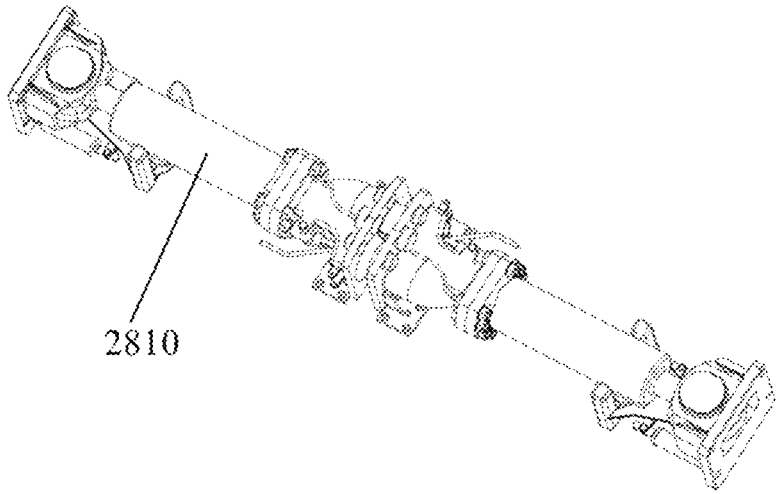
FIG. 32 is a diagram of a docking buffer being connected.

As shown in FIG. 20, the structure of the support vehicle docking mechanism 3200 is the same as that of the roadheader docking mechanism 2800, consisting of a docking buffer apparatus c 3210, a docking buffer apparatus d 3220, a magnetic suction docking plate b 3231, and a conical protruding block 3232. The magnetic suction docking plate b 3231 is bolted to the end of the support vehicle docking mechanism mounting seat 3103. The structures of the docking buffer apparatus c 3210 and the docking buffer apparatus d 3220 are the same as the docking buffer apparatus of a high-speed train carriage. When the docking buffer apparatus a 2810, the docking buffer apparatus b 2820, the docking buffer apparatus c 3210, and the docking buffer apparatus d 3220 are connected in pairs, the docking buffer apparatuses function as follows: as shown in FIG. 32, when two relatively moving apparatuses connect, collision can occur. To avoid the impact caused by the collision, the primary function of the docking buffer apparatus is to absorb the energy during collision. The buffer apparatuses are disposed at longitudinal connection force points along the tunnel. After two guiding magnetic suction docking plates with protrusions are connected, they suppress the force parallel to the guiding magnetic suction docking plates, preventing misalignment, twisting, and sliding after two apparatus are connected. The structure of the docking buffer apparatus includes a hook head, a hook body, and a hook tail. The thickened front end of a car hook is called the hook head, which houses a hook tongue, a hook tongue pin, a locking pin, a hook tongue pusher, and a hook locking iron. When the apparatus is locked in a connection position, the hook tongue is blocked by the hook locking iron and cannot turn outward; during unlocking, the hook locking iron is lifted, and the hook tongue can turn outward as long as it receives a pulling force. When an unhooking apparatus disconnects, as long as one of the car hooks is in the unlocked position, the two apparatus can be separated. This process is completed by the controller. The conical protruding block 3232 of the magnetic suction docking plate b 3231 is magnetic and fits in an attracting manner into a conical groove 2833 on the magnetic suction docking plate a 2831, guiding the magnetic suction docking plate a 2831 to be docked and locked with the magnetic suction docking plate b 3231. This connects the roadheader chassis portion 2000 and the support vehicle chassis portion 3000 into a whole facilitating soil transportation and the mounting of support plates.

Figure 21:
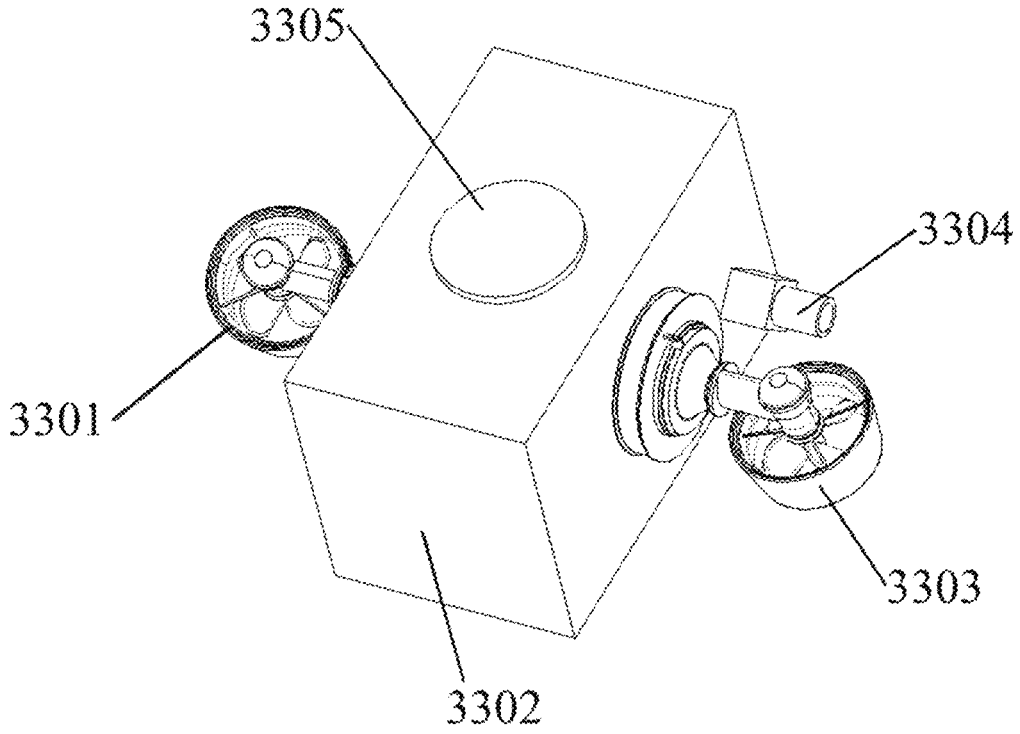
FIG. 21 is a structural diagram of a support vehicle float box portion.
Figure 22:
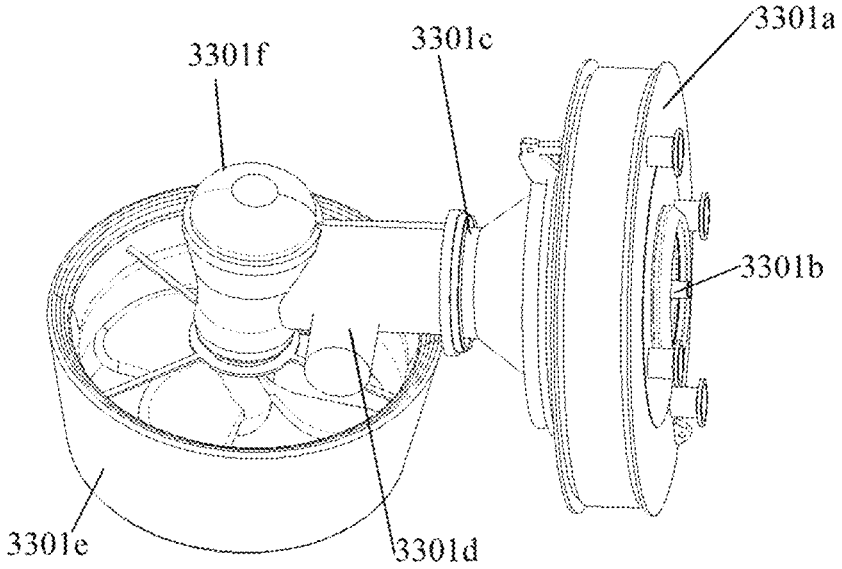
FIG. 22 is a structural diagram of a turbine propeller.

As shown in FIG. 21, the structure of the lifting float box c 3300 includes a propeller c 3301, a high-pressure sealed water tank 3302, a propeller d 3303, and an electromagnetic water valve 3304. The high-pressure sealed water tank 3302 can withstand pressure in an underwater high-pressure environment. The high pressure drainage pump b 3600 is used to pump water in and out of the lifting float box c 3300 and the lifting float box d 3400. When the apparatus needs to descend over a long distance, the electromagnetic water valve 3304 of the water tank can be opened, allowing seawater to automatically enter, increasing the weight of the apparatus, and accelerating the descent of the apparatus. When the apparatus needs to ascend over a long distance, the high pressure drainage pump b 3600 can be used to pump out part of water from the tank, creating a certain negative pressure inside the tank, reducing the weight of the apparatus, improving the efficiency of the propeller, and accelerating the ascent of the apparatus. The propeller c 3301 and the propeller d 3303 are fixed to both sides of the high-pressure sealed water tank 3302 as shown in FIG. 21. They provide power to the apparatus through reverse thrust from turbines, while three hydraulic motors are used to complete switching of propulsion direction, achieving multi-angle propulsion. The propellers cooperate to complete the up, down, front, back, left, and right movement of the apparatus, improving the mobility and flexibility of the apparatus. As shown in FIG. 22, the propeller c 3301 includes a propeller mounting seat 3301*a*, a first hydraulic motor 3301*b*, a first rotary shaft 3301*c*, a second hydraulic motor 3301*d*, a propulsion turbine 3301*e*, and a third hydraulic motor 3301*f*. The propeller mounting seat 3301*a* serves as the mounting base. The first hydraulic motor 3301*b* is fixed inside the propeller mounting seat 3301*a*, with its output shaft connected to the first rotary shaft 3301*c*, driving the first rotary shaft 3301*c* to rotate synchronously. The second hydraulic motor 3301*d* is fixed to the side wall of the first rotary shaft 3301*c*, with its output shaft connected to the third hydraulic motor 3301*f*. The third hydraulic motor 3301*f* is also hinged to the end of the first rotary shaft 3301*c* through a pin shaft. The second hydraulic motor 3301*d* can drive the entire third hydraulic motor 3301*f* to move around the axis of the second hydraulic motor 3301*d*. The propulsion turbine 3301*e* is fixed to the output shaft end of the third hydraulic motor 3301*f* and is driven to rotate by the third hydraulic motor 3301*f*. The three hydraulic motors cooperate to complete switching of the propulsion direction of the turbine, achieving multi-angle propulsion. The propellers cooperate to complete the up, down, front, back, left, and right movement of the apparatus The structure of the lifting float box d 3400 is the same as that of the lifting float box c 3300. It is connected to the lower portion of the support vehicle chassis support 3101 via a quick-connect disk base 3305. During underwater operation, the lifting float box d 3400 and the lifting float box c 3300 are used for support and movement. When the apparatus operates on land, the crawler chassis 5000 can be switched for land operation, performing land-based tunnel excavation and support work.

The structure of the hydraulic power portion c 3500 is the same as that of the hydraulic power portion a 2500. The underwater motor is powered by a ship-borne power source above the water, driving the hydraulic pump to produce high-pressure hydraulic oil. The control valve distributes flow direction of the hydraulic oil and controls the on-off of the oil path. The hydraulic oil storage tank serves as the storage unit for hydraulic oil, providing hydraulic oil for the apparatus, and supplying power to the support vehicle chassis portion 3000 and the support vehicle main body portion 4000. The output end of the high pressure drainage pump b 3600 is connected to the interiors of the lifting float box d 3400 and the lifting float box c 3300 through high-pressure water pipes, and the input end of the high pressure drainage pump b 3600 is connected to the surrounding water. When the apparatus needs to descend over a long distance, the electromagnetic water valve of the water tank can be opened, allowing seawater to enter, increasing the weight of the apparatus, and accelerating its descent. When the apparatus needs to ascend over a long distance, the high pressure drainage pump b 3600 is used to extract part of the water from the tank, creating a certain negative pressure inside the tank, reducing the weight of the apparatus, improving the efficiency of the propellers, and accelerating the ascent of the apparatus.

Figure 23:
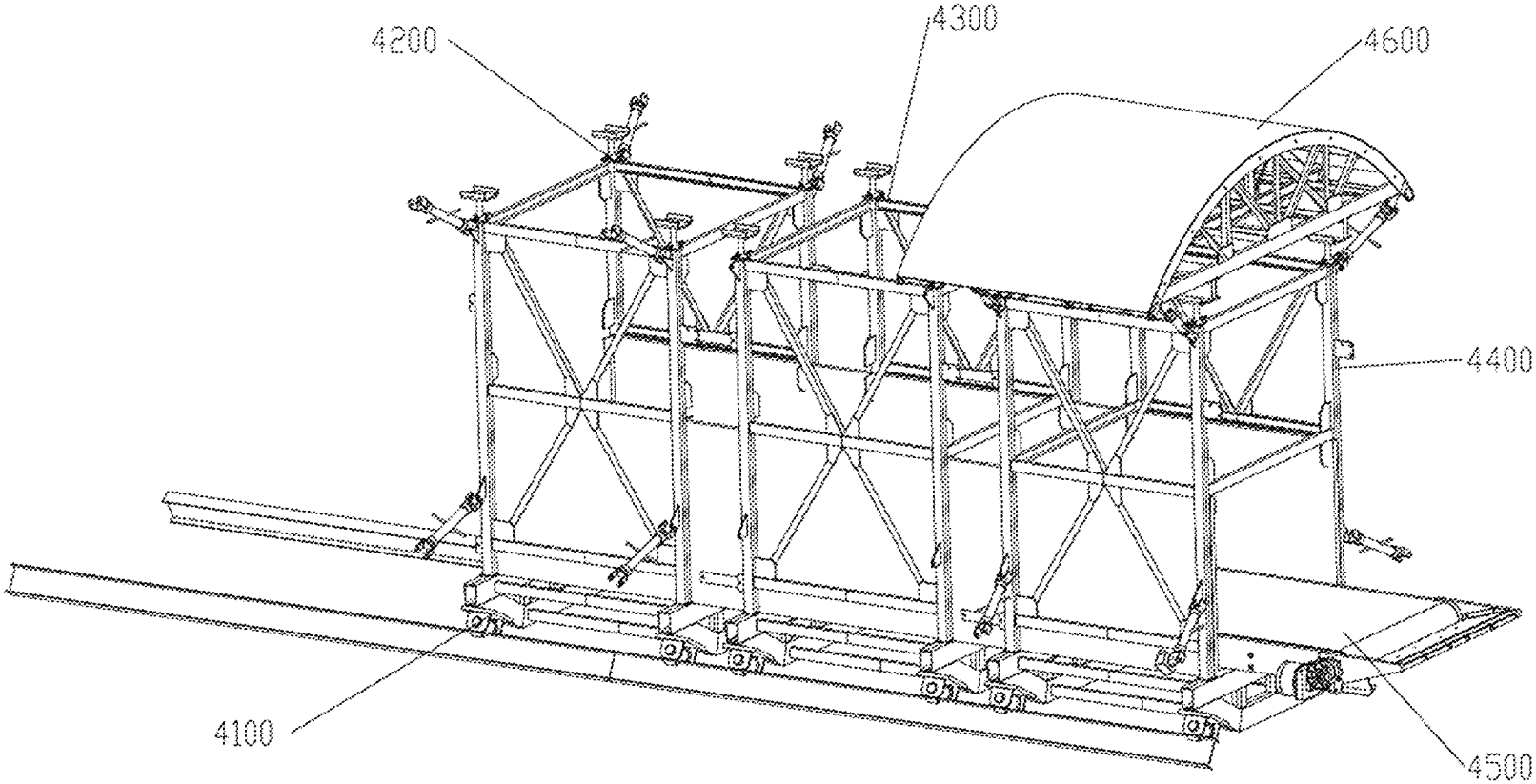
FIG. 23 is an axial view of an entire support vehicle.

As shown in FIG. 23, the support vehicle main body portion 4000 includes a rail car 4100, a support vehicle frame a 4200, a support vehicle frame b 4300, a support vehicle frame c 4400, a cargo box 4500, and tunnel support plates 4600. The rail car 4100 is configured to support and move the support vehicle frame a 4200, the support vehicle frame b 4300, and the support vehicle frame c 4400. The support vehicle frame a 4200, the support vehicle frame b 4300, and the support vehicle frame c 4400 jointly support and mount the tunnel support plates 4600, which are used to support the inner walls of the tunnel soil. The structures and logic connection relationships of the foregoing portions are described in detail below.

Figure 24:
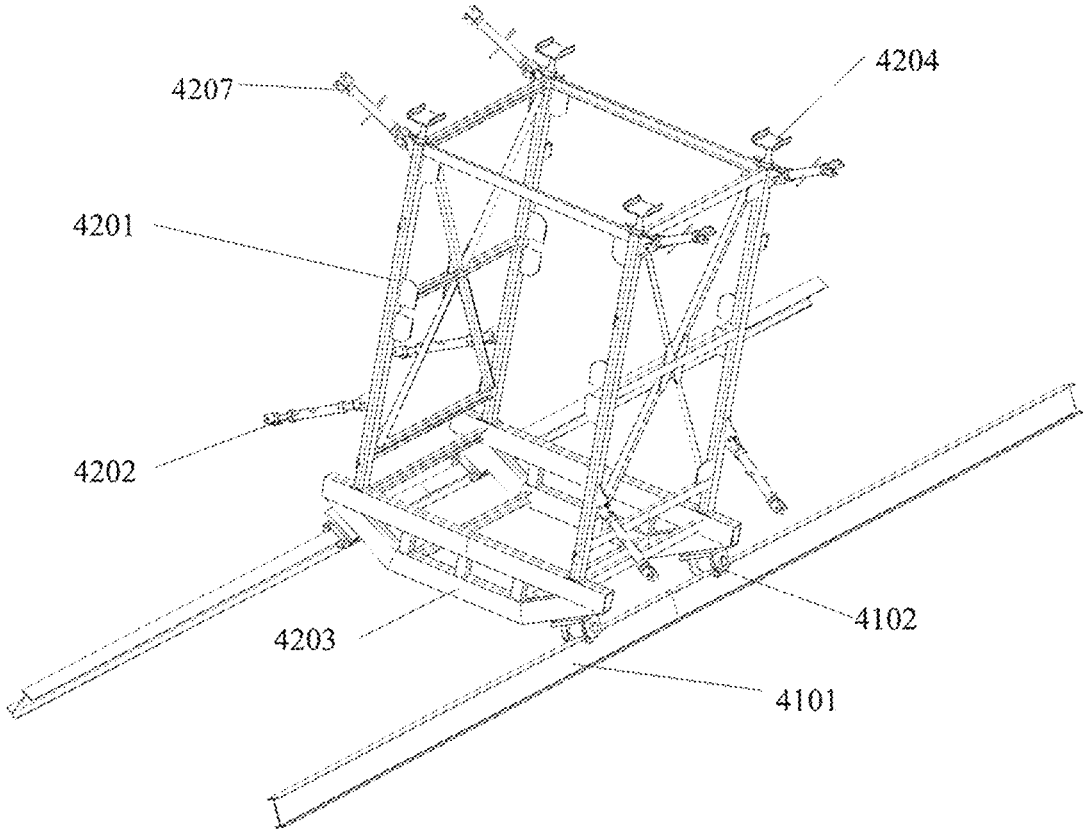
FIG. 24 is a partially structural diagram of a support vehicle frame.
Figure 25:
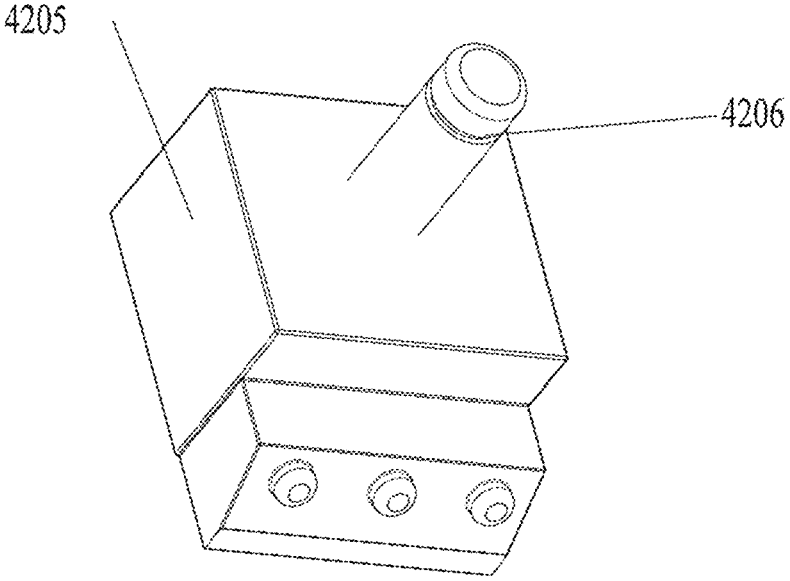
FIG. 25 is a structural diagram of an electromagnetic lock bolt.

The rail car 4100 includes two I-shaped steel rails 4101 and I-shaped steel rollers 4102. As shown in FIG. 24, the I-shaped steel rails 4101 are obliquely, fixedly mounted on two inclined end surfaces of the concave beam 3102, enhancing the load-bearing capacity and stability of the rail car 4100. The I-shaped steel rollers 4102 are equipped with hydraulic motors that drive the I-shaped steel rollers to rotate. The I-shaped steel rollers 4102 cooperate with the I-shaped steel rails 4101, allowing the I-shaped steel rollers 4102 to move along the axis direction of the I-shaped steel rails 4101. The support vehicle frame a 4200, the support vehicle frame b 4300, and the support vehicle frame c 4400 have the same structure. The support vehicle frame a 4200 includes welded steel frames 4201, support plate support cylinders 4202, rail car beams 4203, support plate support arms 4204, electromagnetic controllers 4205, and movable pin shafts 4206. The welded steel frame 4201 is a steel frame structure formed by welding square steel and angle steel, its bottom being bolted above the I-shaped steel roller 4102, and is configured to support and bear the tunnel support plates 4600. The support plate support cylinders 4202 are telescopic cylinders and mounted around the support vehicle frame as shown in FIG. 24. The end of its telescopic end is fixed with a Y-shaped hinge seat (i.e., Y-type hinge seat) 4207 which is hinged with the tunnel support plate hinge seat 4604 via the movable pin shaft 4206. The electromagnetic controller 4205 is fixed to the side wall of the Y-shaped hinge seat 4207, and the movable pin shaft 4206 coaxially fits with the pin hole of the Y-shaped hinge seat 4207. On the top and two sides of the support vehicle frame a 4200, the support vehicle frame b 4300, and the support vehicle frame c 4400, the three tunnel support plates can be supported by the support plate support cylinders 4202. The three support plates are connected to each other through the support plate hinge seats 4604. The angle between the three tunnel support plates can be adjusted using the support plate support cylinders 4202, facilitating the entry of the support plates into the tunnel. When the tunnel support plate detaches from the support vehicle frame, the three tunnel support plates fall into the tunnel, completing the tunnel support.

It should be noted that the I-shaped steel rails 4101 of the support vehicle main body portion 4000 are fixedly mounted on inclined surfaces at two ends of the concave beam 3102. The I-shaped steel rails 4101 are relatively long and extend outward, suspended over a certain length relative to the support vehicle chassis portion 3000. When the roadheader chassis portion 2000 is docked with the support vehicle chassis portion 3000, the suspended I-shaped steel rails 4101 are located directly above the roadheader chassis portion 2000, but the load-bearing force is on the support vehicle chassis portion 3000. The I-shaped steel rollers move on the I-shaped steel rails 4101 without interfering with the roadheader chassis portion 2000.

Figure 26:
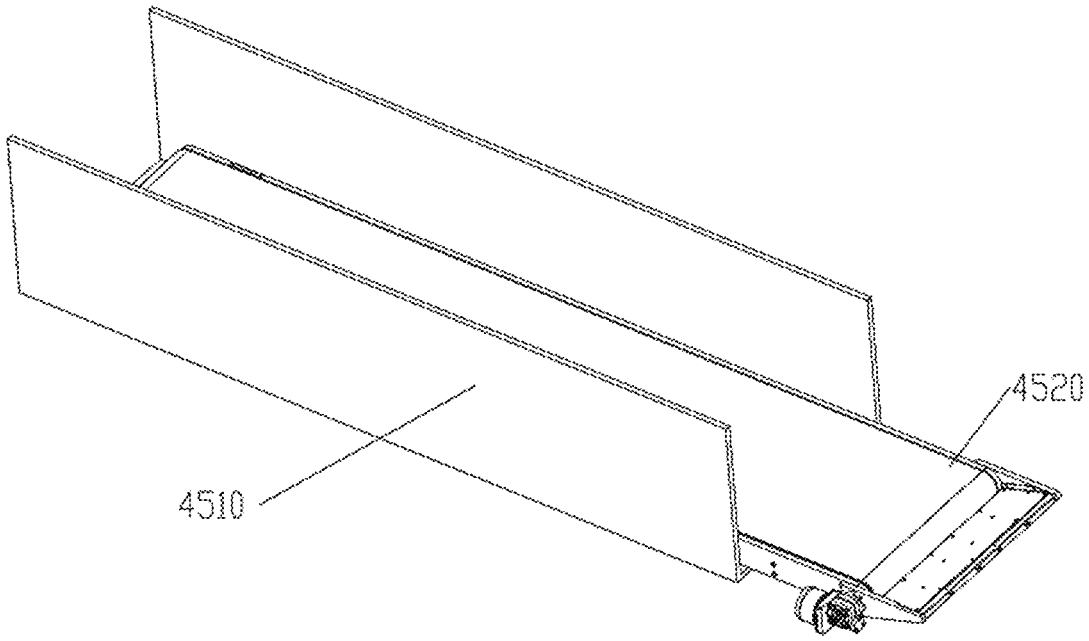
FIG. 26 is a structural diagram of a soil cargo box.

As shown in FIG. 26, the cargo box 4500 includes an opening cargo box 4510 and a cargo box conveyor belt 4520. The opening cargo box 4510 is a rectangular steel container with three surfaces open, and fixed to the inner sides of the support vehicle frame a 4200, the support vehicle frame b 4300, and the support vehicle frame c 4400. The cargo box conveyor belt 4520 is driven by a hydraulic motor and can convey the soil inside the opening cargo box 4510 to the tail portion of the apparatus. The magnetic suction docking plate a 2831 is docked with the magnetic suction docking plate b 3231 for locking, connecting the roadheader chassis portion 2000 and the support vehicle chassis portion 3000 into a whole. When the toothed digging bucket rotates above the soil conveyor belt 2104, the soil inside falls onto the soil conveyor belt 2104 and is transported into the cargo box 4500. When the soil conveyor belt 2104 conveys the soil, the I-shaped steel rollers 4102 can move along the axial direction of the I-shaped steel rail 4101. The support vehicle frame a 4200, the support vehicle frame b 4300, and the support vehicle frame c 4400 drive the cargo box 4500 to move along the axis of the I-shaped steel rail 4101, facilitating the filling of the middle and both ends of the cargo box 4500, thus solving the problem of local soil accumulation. Once the soil fills up the cargo box 4500, the docking mechanisms are controlled for disconnection of the roadheader chassis portion 2000 from the support vehicle chassis portion 3000. The support vehicle main body portion 4000 transports the soil out of the tunnel and the cargo box conveyor belt 4520 is activated to convey the soil out of the apparatus, completing the transportation of soil from the tunnel to the outside.

Figure 27:
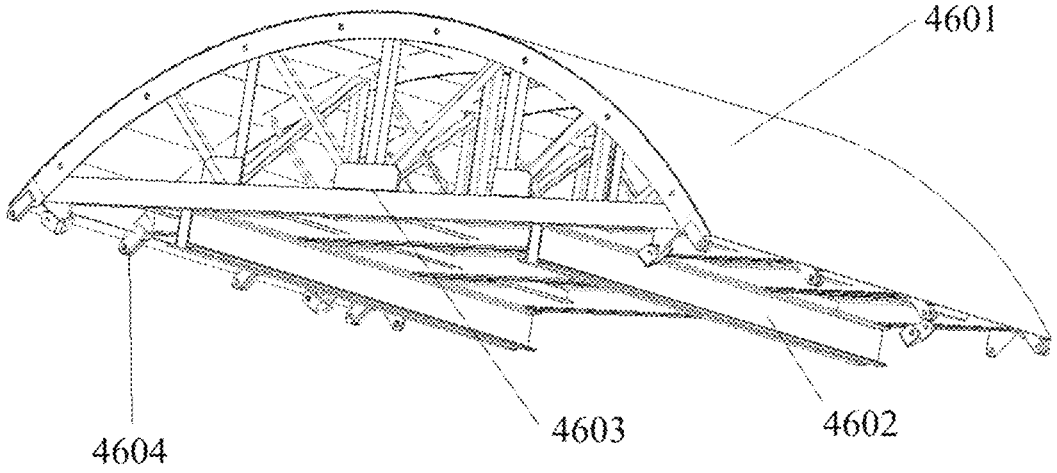
FIG. 27 is a structural diagram of a tunnel support plate.

As shown in FIG. 27, the tunnel support plate 4600 includes a tunnel support plate arch top 4601, a support plate I-shaped steel 4602, a support plate steel frame 4603, and a support plate hinge seat 4604. The support plate I-shaped steel 4602 serves as a backbone bearing beam of the tunnel support plate 4600. The support plate steel frame 4603 is a welded curved steel frame and used to support and bear the tunnel support plate arch top 4601. The tunnel support plate arch top 4601 is an arc-shaped steel plate that, after mounted, contacts the soil of the inner wall of the tunnel, providing support to prevent soil from falling. The support plate hinge seat 4604 serves as a hinge joint between support plates, splicing the three support plates into a semicircular tunnel structure. And it provides a connection for the hinged end of the support plate support cylinder 4202.

Figure 33:
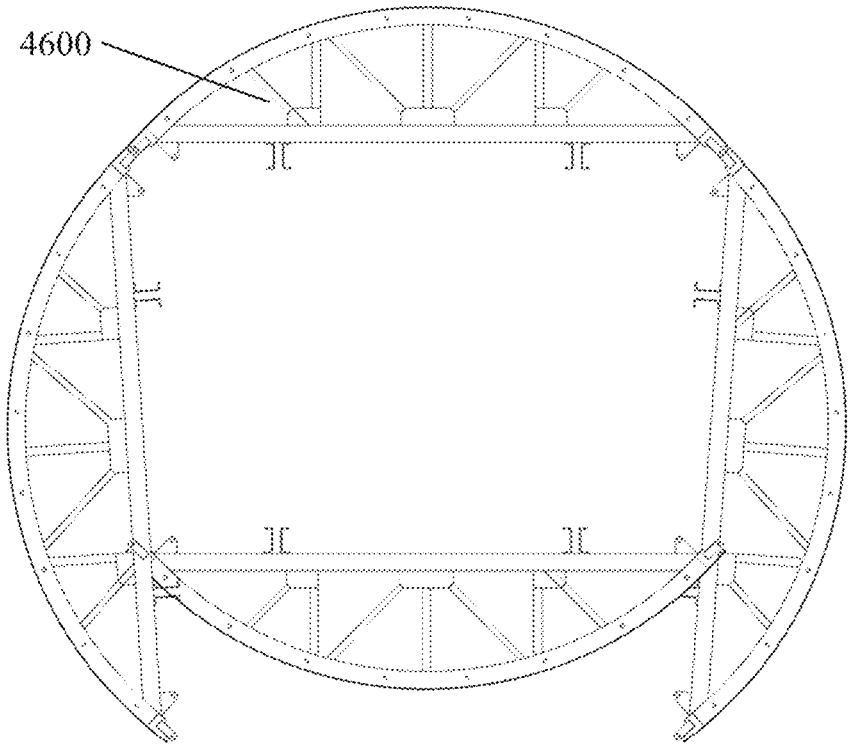
FIG. 33 is a diagram of a ring support plate during transport.

During operation, the support vehicle main body portion 4000 floats above the water surface. A lifting ship hoists the tunnel support plate 4600 onto the three cylinder mounting surfaces of the support vehicle frame a 4200, the support vehicle frame b 4300, and the support vehicle frame c 4400. The support plate hinge seat 4604 and the pin hole of the Y-shaped hinge seat 4207 at the telescopic end of the support plate support cylinder 4202 are coaxial. When the electromagnetic controller 4205 is powered, it uses electromagnetic force to push out the movable pin shaft 4206, hinging the support plate hinge seat 4604 to the Y-shaped hinge seat 4207 of the telescopic end of the support plate support cylinder 4202. The three tunnel support plates are hinged to the support vehicle frame. The telescopic actions of multiple support plate support cylinders 4202 are controlled to adjust the relative positions of the three tunnel support plates 4600, causing the three hinged support plates to retract, and making the outer dimensions less than those of inner wall of the tunnel. The lower ends of the support plates on two sides retract towards the apparatus, and the top-hinged support plate lowers its height for easy entry into the tunnel. The fourth support plate at the bottom is designed with grooves at both ends to latch onto the support steel frames of the support plates on two sides. The fourth support plate lies flat at ends of the support plates on two sides, that is, the fourth support plate is supported below by the support plates on two ends. The specific placement method is shown in FIG. 33, with all the support plates being annular, to reduce the volume for easy entry into the tunnel. The support vehicle main body portion 4000 is controlled to descend underwater and a turbine is used to propel and transport it into the tunnel.

The support vehicle main body portion 4000 is controlled to enter the tunnel, the magnetic suction docking plate a 2831 is docked with the magnetic suction docking plate b 3231 for locking, and the roadheader chassis portion 2000 and the support vehicle chassis portion 3000 are connected into a whole. The telescopic actions of multiple support plate support cylinders 4202 are controlled to adjust the relative positions of the tunnel support plates 4600 being annular until the tunnel support plates expand to support the soil of the inner wall of the tunnel. When the rotary digging drill operates for boring, the I-shaped steel rollers 4102 move forward synchronously. Upon contacting the soil tunnel, the support plate support cylinder is controlled to open the bottoms of the tunnel support plates on the two sides. The fourth support plate slowly descends to the tunnel bottom under gravity. The support plate support cylinders are controlled to dock the protrusions below the support plates on two sides with the grooves designed on the fourth support plate at the bottom. The electromagnetic controller 4205 is controlled to power off, causing the electromagnetic force to disappear. The movable pin shaft 4206 retracts into the electromagnetic controller 4205 under spring tension of the electromagnetic controller 4205, disengaging the support plate hinge seat 4604 from the Y-shaped hinge seat 4207 of the telescopic end of the support plate support cylinder 4202. The electromagnetic controller 4205 retracts the movable pin shaft 4206, detaching the support plates on two sides from the apparatus. Subsequently, the top support plate also detaches from the apparatus. The bottom tunnel support plate and the three hinged tunnel support plates 4600 land in the tunnel, thus completing the mounting of the tunnel support plates.

Figure 28:
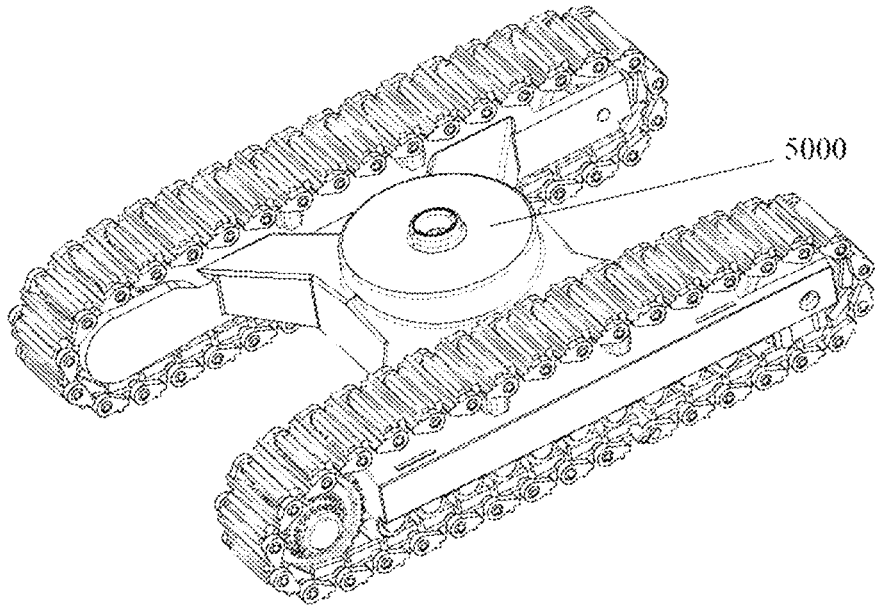
FIG. 28 is a structural diagram of a moving crawler.

As shown in FIG. 28, the crawler chassis 5000 is a hydraulically driven conventional crawler chassis that can be quickly bolted to the docking portion of the apparatus and connected to the hydraulic control oil path. It can switch to land operation to complete land tunnel boring and support plate mounting operation. The float box below the chassis of the apparatus is fixedly connected to a docking mounting disk of the crawler chassis via bolts. During underwater operation, before launching the apparatus into water, a hoisting machine is used to assist in docking the apparatus chassis with a water box, and a worker connects them using bolts. After assembly, the apparatus can be placed underwater for use. During land operation, before the apparatus is transported, the hoisting machine is used to assist in docking the apparatus chassis with a crawler chassis, and the worker connects them using bolts. After assembly, the apparatus can be placed on lands for use.

The following describes the operation principle of the amphibious tunnel construction robot of the present invention with reference to FIGS. 1 to 33 and the description of the foregoing structural and technical features:

The rotary digging drill 1000 is formed by a disk drill a 1100, a disk drill b 1200, a disk drill c 1300, and a guide drill 1400. The disk drill a support 1120 supports and drives disk drill a 1100, the disk drill b support 1220 supports and drives disk drill b 1200, and the disk drill c support 1320 supports and drives disk drill c 1300. The three disk drill supports are fixedly connected in pairs through square steel and welded to the roadheader chassis support 2101. The guide drill 1400 is fixed to the roadheader chassis support 2101 through the guide-drill fixed square steel 1422 and driven to rotate by the guide drill power transmission mechanism 1430, achieving the function of crushing rock walls and guiding small hole excavation.

The roadheader chassis mechanism 2100 is used to fix and bear the rotary digging drill 1000, can propel the rotary digging drill 1000 to move, and control the movement direction of the apparatus. The roadheader chassis mechanism 2100 includes a roadheader chassis support 2101, a propeller a 2102, a propeller b 2103, and a soil conveyor belt 2104. The structure of the roadheader chassis support 2101 is as shown in FIG. 11 and same as that of the support vehicle chassis support 3101. The roadheader chassis support 2101 is welded from a high-strength channel steel and a reinforced beam, possessing a high load-bearing capacity. The structures of the propeller a 2102 and the propeller b 2103 are the same as the structure of propeller c 3301. They provide power to the apparatus through reverse thrust from turbines, while three hydraulic motors are used to complete switching of propulsion direction, achieving multi-angle propulsion. The propellers cooperate to complete the up, down, front, back, left, and right movement of the apparatus, improving the mobility and flexibility of the apparatus. The output end of the high pressure drainage pump a 2700 is connected to the interiors of the lifting float box a 2200 and the lifting float box b 2300 via high pressure water pipes, and the input end of the high pressure drainage pump a 2700 is connected to the surrounding water. When the apparatus needs to descend over a long distance, the electromagnetic water valve of the water tank can be opened, allowing seawater to enter, increasing the weight of the apparatus, and accelerating its descent. When the apparatus needs to ascend over a long distance, the high pressure drainage pump a 2700 is used to extract part of the water from the tank, creating a certain negative pressure inside the tank, reducing the weight of the apparatus, improving the efficiency of the propellers, and accelerating the ascent of the apparatus.

The support vehicle chassis mechanism 3100 is configured to support and bear the support vehicle main body portion 4000, and can propel and bear the support vehicle main body portion 4000, and control the movement direction of the apparatus. During operation, the two support arm b auxiliary arms 3106 extend out, and the hydraulic AGV universal wheels are controlled to stop and move, stabilizing the entire apparatus and ensuring the stability of tunnel boring. During movement, the two support arm b auxiliary arms 3106 retract, causing the apparatus to lose support. Multiple propellers can move in the tunnel to adjust the direction of the excavation apparatus, facilitating the transportation and mounting of the tunnel support plates. When the apparatus needs to descend over a long distance, the electromagnetic water valve 3304 of the water tank can be opened, allowing seawater to enter, increasing the weight of the apparatus, and accelerating its descent. When the apparatus needs to ascend over a long distance, the high pressure drainage pump b 3600 is used to extract part of the water from the tank, creating a certain negative pressure inside the tank, reducing the weight of the apparatus, improving the efficiency of the propellers, and accelerating the ascent of the apparatus. The propeller c 3301 and the propeller d 3303 are fixed to both sides of the high-pressure sealed water tank 3302 as shown in FIG. 18. They provide power to the apparatus through reverse thrust from turbines, while three hydraulic motors are used to complete switching of propulsion direction, achieving multi-angle propulsion. The propellers cooperate to complete the up, down, front, back, left, and right movement of the apparatus, improving the mobility and flexibility of the apparatus.

During soil transportation, when the toothed digging bucket rotates above the soil conveyor belt 2104, the soil inside falls onto the soil conveyor belt 2104 and is transported into the cargo box 4500. When the soil conveyor belt 2104 transports soil, the I-shaped steel rollers 4102 can move along the axis direction of the I-shaped steel rail 4101. The support vehicle frame a 4200, the support vehicle frame b 4300, and the support vehicle frame c 4400 drive the cargo box 4500 to move along the axis of the I-shaped steel rail 4101, facilitating the filling of the middle and both ends of the cargo box 4500, thus solving the problem of local soil accumulation in the cargo box. Once the soil fills up the cargo box 4500, the docking mechanisms are controlled for disconnection of the roadheader chassis portion 2000 from the support vehicle chassis portion 3000. The support vehicle main body portion 4000 transports the soil out of the tunnel and the cargo box conveyor belt 4520 is activated to convey the soil in the cargo box out of the apparatus, completing the transportation of soil from the tunnel to the outside.

During operation, the support vehicle main body portion 4000 floats above the water surface. A lifting ship hoists the tunnel support plate 4600 onto the three cylinder mounting surfaces of the support vehicle frame a 4200, the support vehicle frame b 4300, and the support vehicle frame c 4400. The support plate hinge seat 4604 and the pin hole of the Y-shaped hinge seat 4207 at the telescopic end of the support plate support cylinder 4202 are coaxial. When the electromagnetic controller 4205 is powered, it uses electromagnetic force to push out the movable pin shaft 4206, hinging the support plate hinge seat 4604 to the Y-shaped hinge seat 4207 of the telescopic end of the support plate support cylinder 4202. The three tunnel support plates are hinged to the support vehicle frames. The telescopic actions of multiple support plate support cylinders 4202 are controlled to adjust the relative positions of the three tunnel support plates 4600, causing the three hinged support plates to retract, and making the outer dimensions less than those of inner wall of the tunnel. The support vehicle main body portion 4000 is then controlled to sink underwater and propelled and transported into the tunnel using the turbines. During production, load-bearing steel plates are welded above the steel frame of the inner wall of the tunnel support plate, forming flat four walls of the inner wall of the tunnel.

The auxiliary arm a 2402 and auxiliary arm b 2403 of the apparatus extend out, and the toothed wheels of the hydraulic AGV universal wheel a 2404 and hydraulic AGV universal wheel b 2405 can contact both the inner wall of the tunnel support plate and the inner wall of soil of the tunnel. During operation, single annular support plates on the support vehicle main body portion 4000 are independent of each other. After the annular support plates are initially loaded, the initial position of the support vehicle main body portion 4000 with the annular support plates is at the rear position of the support vehicle chassis portion 3000, with the support arms retracted within the annular support plates. The support arms of the roadheader chassis portion 2000 are in an extended support state. When the support vehicle chassis portion 3000 is docked and fixed with the roadheader chassis portion 2000, the single annular support plates do not touch the support arms of the roadheader chassis portion 2000. The distance between the two support arms of the apparatus can accommodate the width of three complete annular support plates. When the support vehicle main body portion 4000 moves forward to the position of the support arms of the roadheader chassis portion 2000, the support arms of the support vehicle chassis portion 3000 extend out, and the toothed wheels of the hydraulic AGV universal wheels contact the inner wall of the tunnel support plates and support the apparatus. The support arms of the roadheader chassis portion 2000 retract, allowing the support vehicle main body portion 4000 to continue moving forward to the vicinity of the drill. The roadheader drill (i.e., the rotary digging drill) can continue operation, and the support plates can also move forward synchronously to support the tunnel. The support vehicle chassis portion 3000 is rigidly connected to the roadheader chassis portion 2000, and their support arms can be alternately switched to stabilize the normal operation of the entire apparatus.

When the roadheader chassis portion 2000 moves forward in the tunnel for boring, it relies on the cooperation of the hydraulic AGV universal wheels of the two support arms for propulsion. During long-distance transfer, the hydraulic AGV universal wheels of the two support arms are not wrapped by the tunnel support plates, which does not affect propulsion. Regarding the movement of the support vehicle chassis portion 3000, (1) the tail flow generated due to propulsion of the propeller impacts the tunnel support plates in the opposite direction, causing the support plates to be subjected to a force opposite to the propulsion direction, and affecting the pushing efficiency of the apparatus. However, the design of the apparatus allows for a large distance between the propeller and the support plates. Water has a certain viscosity, and the reverse tail flow dissipates in all directions after flowing a long distance, significantly reducing momentum. The actual force impacting the tunnel support plates is small, and it, although affecting the propulsion of the apparatus, is a small part relative to the thrust obtained by the propeller. (2) To reduce the above impact, after three annular support plates are loaded on the support vehicle chassis portion 3000, the adjacent propellers of the lifting float box d 3400 and the lifting float box c 3300 are located within the annular support plates. The two are mainly used for forward and backward power control in the axial direction of the apparatus. Their reverse water flow is mainly along the axial direction of the annular tunnel, reducing the impact force of the water flow on the tunnel support plates. The propellers at two outer ends of the lifting float box d 3400 and lifting float box c 3300 are located outside the edge of the annular tunnel support plates. Most of the water flow generated by the propulsion flows to the outside of the apparatus, not generating a significant counterforce on the annular support plates. Therefore, the propellers at the two outer ends are mainly used for steering and posture adjustment of the support vehicle chassis portion 3000. After the tunnel support plates are unloaded, all propellers can be normally used for propulsion in all directions.

When the support plates are on part of the support vehicle chassis portion 3000, tunnel boring and support need simultaneous balance for operation. Another unloaded support vehicle portion is flexibly called to dock at the rear of the apparatus. The soil is conveyed to the second support vehicle main body portion 4000 using the conveyor belt inside the first support vehicle main body portion 4000. The second unloaded support vehicle main body portion 4000 is used to transport the soil. Meanwhile, multiple support vehicle main body portions 4000 can be flexibly called to transport support plates. After the support plates of the first support vehicle main body portion 4000 are used up, the roadheader stops operating. The support arms of the roadheader chassis portion 2000 extend out to assist in stabilizing the apparatus and disconnecting from the first support vehicle main body portion 4000. The first support vehicle main body portion 4000 moves to the tunnel junction or outside the tunnel. The second support vehicle main body portion 4000, with support plates pre-assembled at the tunnel junction or outside the tunnel, can enter the tunnel and be docked with the roadheader chassis portion 2000, completing the operation of the first support vehicle main body portion 4000. This process is repeated in the above cycle.

The support vehicle main body portion 4000 is controlled to enter the tunnel, the magnetic suction docking plate a 2831 is docked with the magnetic suction docking plate b 3231 for locking, and the roadheader chassis portion 2000 and the support vehicle chassis portion 3000 are connected into a whole. The telescopic actions of multiple support plate support cylinders 4202 are controlled to adjust the relative positions of the three tunnel support plates 4600 until the tunnel support plates expand to support the soil of the inner wall of the tunnel. The electromagnetic controller 4205 is controlled to power off, causing the electromagnetic force to disappear. The movable pin shaft 4206 retracts into the electromagnetic controller 4205 under spring tension of the electromagnetic controller 4205, disengaging the support plate hinge seat 4604 from the Y-shaped hinge seat 4207 of the telescopic end of the support plate support cylinder 4202. The three hinged tunnel support plates 4600 land in the tunnel, thus completing the mounting of the tunnel support plates.

During use on land, before the apparatus is transported, a crane is used to assist in docking the apparatus chassis with the crawler chassis. A worker connects bolts, and the crawler can move directly on a load-bearing steel plate of the tunnel support plates. During operation, there is no need for auxiliary fixation by support arms, and the apparatus can be stabilized solely by its own weight. The tunnelling and support processes are the same as the foregoing underwater operation processes.

The above descriptions are only specific implementations of the present invention. However, the protection scope of the present invention is not limited thereto. Any modifications or substitutions that can be understood and made by those skilled in the art within the disclosed technical scope of the present invention should be included within the scope of the present invention.

What is claimed is:

1. An amphibious tunnel construction robot, comprising:

a rotary digging drill, wherein the rotary digging drill comprises:

three disk drills arranged in ascending order of diameter, each with a cavity therein, wherein each disk drill comprises two circular ring seats arranged side by side, multiple toothed digging buckets disposed at peripheries of the two circular ring seats, and ring gear racks respectively disposed on inner sides of the two circular ring seats; and a periphery of each toothed digging bucket is provided with steel teeth and each toothed digging bucket has openings in different sizes at two ends; and wherein adjacent ones of the disk drills have the toothed digging buckets facing opposite directions, and the disk drills all rotate in a direction facing a large opening, enabling adjacent two of the three disk drills to rotate in opposite directions; and the rotary digging drill further comprises:

three disk drill supports that match the three disk drills in quantity and are configured to support and drive the three disk drills, each two of the three disk drill supports being connected to each other; and a guide drill having a head end disposed at a front end of the disk drill with a minimum diameter and having a tail end running through the three disk drills; and wherein the robot further comprises a roadheader chassis portion, a support vehicle chassis portion connected to the roadheader chassis portion via a docking mechanism, and a support vehicle main body portion disposed on the support vehicle chassis portion;

wherein the roadheader chassis portion comprises a roadheader chassis mechanism configured to fix and bear the rotary digging drill, the roadheader chassis mechanism comprises a roadheader chassis support and two propellers that are disposed on two sides of the roadheader chassis support and face different directions, and a soil conveyor belt is disposed on a side above the roadheader chassis support; and wherein an end of the roadheader chassis mechanism provided with the soil conveyor belt extends into the cavities of the three disk drills, and the soil conveyor belt is powered by a hydraulic motor to transport soil excavated by the rotary digging drill to rear.

2. The amphibious tunnel construction robot according to claim 1, wherein the support vehicle chassis portion comprises a support vehicle chassis mechanism, the support vehicle chassis mechanism comprises a support vehicle chassis support, multiple concave beams disposed below the support vehicle chassis support, and a support vehicle docking mechanism mounting seat disposed at an end of the support vehicle chassis support; and the support vehicle docking mechanism mounting seat is mounted with a support vehicle docking mechanism.

3. The amphibious tunnel construction robot according to claim 2, wherein the support vehicle docking mechanism comprises a magnetic suction docking plate, a docking buffer apparatus connected to the magnetic suction docking plate, and a protruding block and a groove disposed at docking ends of the magnetic suction docking plate; and a roadheader docking mechanism comprised by the roadheader chassis portion has a same structure with the support vehicle docking mechanism; the docking buffer apparatus comprised by the support vehicle docking mechanism docks with a docking buffer apparatus comprised by the roadheader docking mechanism; and the protruding block is magnetic, the magnetic suction docking plate of the support vehicle docking mechanism and a magnetic suction docking plate of the roadheader docking mechanism are in absorbing fitting with each other via the protruding block and the groove disposed on the magnetic suction docking plate of the support vehicle docking mechanism and a protruding block and a groove disposed on the magnetic suction docking plate of the roadheader docking mechanism, achieving locking, thus allowing for connection between the roadheader chassis portion and the support vehicle chassis portion.

4. The amphibious tunnel construction robot according to claim 2, wherein a lifting float box and a support arm are disposed below each of the roadheader chassis mechanism and the support vehicle chassis mechanism, a drainage pump is connected into the lifting float box via a water pipe, and the drainage pump is configured to pump water in and out of the lifting float box; and the support arm comprises a main arm and auxiliary arms extending or retracting at two ends of the main arm via hydraulic cylinders, and hydraulic automated guided vehicle (AGV) universal wheels are respectively disposed on ends of the auxiliary arms opposite to each other.

5. The amphibious tunnel construction robot according to claim 4, wherein the lifting float box comprises a sealed water tank and two propellers disposed on two opposite sides of the sealed water tank and facing different directions; each propeller comprises a propeller mounting seat and a first hydraulic motor disposed in the propeller mounting seat, an output shaft of the first hydraulic motor is connected to a first rotary shaft to drive the first rotary shaft to rotate synchronously; and a second hydraulic motor is disposed on a side wall of the first rotary shaft and has an output shaft connected to a third hydraulic motor, the third hydraulic motor is hinged with an end of the first rotary shaft via a pin shaft, the second hydraulic motor is configured to drive the third hydraulic motor to move around an axis of the second hydraulic motor, a propulsion turbine is disposed at an end of an output shaft of the third hydraulic motor and driven by the third hydraulic motor to rotate, and the first, second and third hydraulic motors cooperate to change a propulsion direction of the propulsion turbine for operation, achieving multi-angle propulsion.

6. The amphibious tunnel construction robot according to claim 1, wherein the support vehicle main body portion comprises a rail car comprising I-shaped steel rails and I-shaped steel rollers, the I-shaped steel rails incline on oblique surfaces at two ends of a concave beam, and the I-shaped steel rollers cooperate with the I-shaped steel rails and move along an axial direction of the I-shaped steel rails; three support vehicle frames are disposed at an upper end of the I-shaped steel rollers, each support vehicle frame comprises a welded steel frame supporting and bearing a tunnel support plate, support plate support cylinders are disposed around the support vehicle frame, a Y-type hinge seat is disposed at an end of a telescopic end of each support plate support cylinder and hinged with a support plate hinge seat via a movable pin shaft of an electromagnetic controller, the electromagnetic controller is disposed on a side wall of the Y-type hinge seat, and the movable pin shaft of the electromagnetic controller co-axially cooperates with a pin hole of the Y-type hinge seat, three tunnel support plates are supported by the support plate support cylinders disposed on a top and two side surfaces of each of the three support vehicle frames, the three tunnel support plates are connected via support plate hinge seats, and an angle between the three tunnel support plates is configured to be adjusted via the support plate support cylinders.

7. The amphibious tunnel construction robot according to claim 6, wherein a cargo box is disposed in the support vehicle frame, the cargo box comprises an opening cargo box and a cargo box conveyor belt disposed in the opening cargo box, and the cargo box conveyor belt is driven by the hydraulic motor to convey soil in the opening cargo box to a tail of the amphibious tunnel construction robot; and each tunnel support plate comprises a curved support plate steel frame, a support plate arch top disposed on the curved support plate steel frame, and the support plate hinge seats disposed on the support plate steel frame, and the support plate hinge seats serve as hinge nodes between the tunnel support plates to splice the three tunnel support plates into a half circular tunnel structure.

8. The amphibious tunnel construction robot according to claim 1, wherein each disk drill support comprises a welded trestle bearing the disk drill, multiple bearing seats disposed on the welded trestle, and multiple gear shafts in interference fitting with the multiple bearing seats, each ring gear rack of the disk drill is meshed with a gear on a corresponding gear shaft of the gear shafts, one of the gear shafts is co-axially connected to an output shaft of a hydraulic speed reducing motor via a coupling, and the hydraulic speed reducing motor is configured to transmit power to the gear shaft via the coupling, to thereby drive the disk drill to rotate circumferentially.

9. The amphibious tunnel construction robot according to claim 1, wherein the guide drill comprises a hobbing drill, a guide drill drive box, and a guide-drill fixed square steel that are disposed sequentially, and a guide drill power transmission mechanism is disposed in the guide drill drive box; and the hobbing drill comprises a hobbing drill base, three conical hob bearing shafts uniformly distributed on a head portion of the hobbing drill base, and three conical hobs respectively connected to inner rings of the three conical hob bearing shafts; and a tail portion of the hobbing drill base is co-axially connected to a hobbing drill drive shaft configured to drive the hobbing drill base to rotate synchronously.

* * * * *